US011446953B2

(12) United States Patent
Seri et al.

(10) Patent No.: US 11,446,953 B2
(45) Date of Patent: Sep. 20, 2022

(54) PRESSURIZED-TYPE WRITING IMPLEMENT

(71) Applicant: KABUSHIKI KAISHA PILOT CORPORATION, Tokyo-to (JP)

(72) Inventors: Nobukazu Seri, Tokyo-to (JP); Yusuke Sanada, Tokyo-to (JP)

(73) Assignee: KABUSHIKI KAISHA PILOT CORPORATION, Tokyo-to (JP)

( * ) Notice: Subject to any disclaimer, the term of this patent is extended or adjusted under 35 U.S.C. 154(b) by 221 days.

(21) Appl. No.: 16/627,561

(22) PCT Filed: Jun. 29, 2018

(86) PCT No.: PCT/JP2018/024941
§ 371 (c)(1),
(2) Date: Dec. 30, 2019

(87) PCT Pub. No.: WO2019/004461
PCT Pub. Date: Jan. 3, 2019

(65) Prior Publication Data

US 2020/0215847 A1 Jul. 9, 2020

(30) Foreign Application Priority Data

Jun. 30, 2017 (JP) ..... JP2017-129882
Jun. 30, 2017 (JP) ..... JP2017-129883

(51) Int. Cl.
*B43K 7/035* (2006.01)
*B43K 7/12* (2006.01)
*B43K 24/08* (2006.01)

(52) U.S. Cl.
CPC ..... *B43K 7/035* (2013.01); *B43K 7/12* (2013.01); *B43K 24/08* (2013.01)

(58) Field of Classification Search
CPC . B43K 7/03; B43K 7/035; B43K 7/08; B43K 7/12; B43K 24/08; B43K 24/084; B43K 24/086; B43K 7/10; B43L 19/00
See application file for complete search history.

(56) References Cited

U.S. PATENT DOCUMENTS 3,420,610 A * 1/1969 Malm ..... B43K 7/02 401/112
3,854,826 A * 12/1974 Adams ..... B43K 7/035 401/188 R (Continued)

FOREIGN PATENT DOCUMENTS

CN 1978216 6/2007
CN 101376312 3/2009

(Continued)

OTHER PUBLICATIONS

International Search Report dated Sep. 11, 2018 in corresponding International Application No. PCT/JP2018/024941.

(Continued)

*Primary Examiner* — Patrick M. Buechner
(74) *Attorney, Agent, or Firm* — Wenderoth, Lind & Ponack, L.L.P.

(57) ABSTRACT

A pressurized writing implement includes a shaft tube capable of housing therein a refill filled with a writing implement ink composition. The pressurized writing implement further includes a pressurizing mechanism that applies a pressure to the writing implement ink composition, the pressurized writing implement being capable of switching a writing state in which a front end part of the refill projects from a front end opening of the shaft tube, and a not-writing state in which the front end part of the refill is retracted from the front end opening of the shaft tube. The pressurized (Continued)

writing implement further includes a pressurizing-force adjusting mechanism that adjusts the pressure.

13 Claims, 27 Drawing Sheets

(56) References Cited

U.S. PATENT DOCUMENTS

| | | | | |
|---|---|---|---|---|
| 7,604,427 | B2 * | 10/2009 | Taniguchi | B43K 24/08 401/188 A |
| 2003/0102334 | A1 * | 6/2003 | Usami | B43M 11/08 222/386 |
| 2007/0127976 | A1 * | 6/2007 | Murakoshi | B43K 7/12 401/188 A |
| 2009/0060625 | A1 * | 3/2009 | Taniguchi | B43M 11/085 401/190 |
| 2011/0222953 | A1 * | 9/2011 | Noguchi | B43K 7/03 401/99 |
| 2019/0047318 | A1 * | 2/2019 | Kajiwara | B43K 1/08 |

FOREIGN PATENT DOCUMENTS

| | | | | |
|---|---|---|---|---|
| CN | 105072950 | | 11/2015 | |
| EP | 2 364 861 | | 9/2011 | |
| GB | 1 226 396 | | 3/1971 | |
| JP | 8-141482 | | 6/1996 | |
| JP | 2000-103193 | | 4/2000 | |
| JP | 2000-335173 | | 12/2000 | |
| JP | 2004-142381 | | 5/2004 | |
| JP | 2004-276549 | | 10/2004 | |
| JP | 2004-291248 | | 10/2004 | |
| JP | 2004-322483 | | 11/2004 | |
| JP | 2004-338237 | | 12/2004 | |
| JP | 2005-104119 | | 4/2005 | |
| JP | 2005-305907 | | 11/2005 | |
| JP | 2010-105309 | | 5/2010 | |
| JP | 2010-253872 | | 11/2010 | |
| JP | 2013-6281 | | 1/2013 | |
| JP | 2014-193571 | | 10/2014 | |
| JP | 2015-164788 | | 9/2015 | |
| KR | 10-2011-0097763 | | 8/2011 | |
| WO | WO-2019026808 | A1 * | 2/2019 | B43K 7/03 |

OTHER PUBLICATIONS

International Preliminary Report on Patentability dated Dec. 31, 2019 in corresponding International Application No. PCT/JP2018/024941.

Notification of Reason for Rejection dated May 31, 2019 in corresponding Taiwanese Application No. 107122882 (with English translation).

Office Action dated Jun. 23, 2021 in corresponding Korean Patent Application No. 10-2019-7038525, with English-language translation.

Office Action dated Aug. 19, 2020 in corresponding Chinese Patent Application No. 201880042974.2 with English-language translation.

Extended European Search Report dated Apr. 28, 2021 in corresponding European Patent Application No. 18823390.2.

Office Action dated Dec. 23, 2021 in corresponding Korean Patent Application No. 10-2019-7038525, with English Translation.

* cited by examiner

PRESSURIZED-TYPE WRITING IMPLEMENT

FIELD OF THE INVENTION

The present invention relates to a pressurized-type writing implement.

BACKGROUND ART

As disclosed in JP2000-335173A, for example, a known pressurized-type writing implement of this type has been conventionally provided with a pressurization mechanism at a back end of an ink storage tube, and an inside of the ink filling tube is pressurized in cooperation with a pressing operation of a knock mechanism (nock body).

However, in the pressurized-type writing implement disclosed in JP2000-335173A, once the pressurization mechanism has been once activated, a pressure applied to the ink storage tube cannot be varied. Thus, a handwriting width and/or handwriting density desired by a user cannot be always achieved.

As a technical solution against this problem, JPH08-141482A discloses an applicator capable of optionally adjusting a pressure to be applied to a back end of a correction fluid in a liquid tank.

In the applicator of JPH08-141482A, a rotor at a back end of a shaft tube is rotated stepwise from a push start point toward a push end point of a tank pushing unit of an end in the tube, so that a back end of a liquid tank is pushed to the front side of the shaft tube in accordance with a height of a pressing unit of each stage whereby the liquid tank is compressed stepwise.

However, in the structure of JPH08-141482A, the liquid tank can be pressurized at a given pressurizing force upon use, but a pressurizing force has to be adjusted by rotating the rotor each time of use. In addition, if the liquid tank remains pressurized, there is a risk of liquid leakage. Thus, when terminating the use, it is necessary to rotate the rotor to an original position before storage, which is bothersome.

SUMMARY OF THE INVENTION

The present invention has been made in view of the above problems. The object of the present invention is to provide a pressurized-type writing implement which is capable of pressurizing an inside of an ink storage tube at a given pressurizing force in accordance with a user's taste by rotating a knock body, and is capable of, once a pressurizing force has been set, easily switching a writing state and a not-writing state upon use while maintaining the set pressurizing force.

A pressurized-type writing implement of the present invention a pressurized-type writing implement comprises:

a shaft tube capable of housing therein a refill filled with a writing implement ink composition; and a pressurizing mechanism that applies a pressure to the writing implement ink composition;

the pressurized-type writing implement being capable of switching a writing state in which a front end part of the refill projects from a front end opening of the shaft tube, and a not-writing state in which the front end part of the refill is retracted from the front end opening of the shaft tube, wherein the pressurized-type writing implement has a pressurizing-force adjusting mechanism that adjusts the pressure.

In a pressurized-type writing implement of the present invention:

a ballpoint refill is housed in a shaft tube, wherein the ballpoint refill includes an ink storage tube filled with a writing implement ink composition, and a ballpoint tip on a front part of the ink storage tube;

a pressurized chamber and a pressurizing mechanism that applies a pressure to the pressurized chamber are disposed on a back side of the ballpoint refill, wherein the pressurized chamber is in communication with a back end of the writing implement ink composition; and a front end of the ballpoint refill is configured to project from a front end opening of the shaft tube by pushing a knock body disposed on the back side of the pressurizing mechanism to the front side;

characterized in that:

a cam member is disposed on the front side of the knock body;

a pressurizing-force adjusting mechanism is disposed on the back side of the pressurizing mechanism, wherein the pressurizing-force adjusting mechanism increases or decreases a volume of the pressurized chamber at least during writing, by rotating the knock body; and a first spring body is disposed between an outer step part of the ballpoint refill and an inner step part of the shaft tube, so as to elastically urge the ballpoint refill to the back side with respect to the shaft tube; and when the knock body is pushed to the front side or when the ballpoint refill is moved to the back side by a writing pressure upon writing, the pressurizing mechanism is actuated so as to apply a pressure to the back end of the writing implement ink composition; and the pressure applied to the back end of the writing implement ink composition is configured to be adjustable by the pressurizing-force adjusting mechanism.

In the pressurized-type writing implement of the present invention, a slide member that is formed to be movable in a back and forth direction with respect to the shaft tube may be disposed outside the knock body, the knock body may be locked so as to be rotatable and immovable in the back and forth direction with respect to the slide member, and the cam member may be locked so as to be movable in the back and forth direction and unrotatable with respect to the slide member; and the slide member, the knock body and the cam member may constitute the pressurizing-force adjusting mechanism.

In a pressurized-type writing implement of the present invention:

a ballpoint refill is housed in a shaft tube, wherein the ballpoint refill includes an ink storage tube filled with a writing implement ink composition, and a ballpoint tip on a front part of the ink storage tube;

a pressurizing mechanism that applies a pressure to a back end of the writing implement ink composition is disposed on a back side of the ballpoint refill; and a projecting and retracting mechanism, which is pushed to a front side to project a front end part of the ballpoint refill from a front end opening of the shaft tube, is disposed on the back side of the pressurizing mechanism;

characterized in that:

the projecting and retracting mechanism comprises: a slide member disposed so as to be movable in a back and forth direction and unrotatable with respect to the shaft tube; a knock body rotatably locked on a back part of the slide member, and projecting to the back side from a back end of the shaft tube; and a slidable member disposed inside the slide member and locked so as to be movable in the back and forth direction and unrotatable with respect to the slide member;

the slidable member is locked on the knock body so as to be moved in the back and forth direction in accordance with the rotation of the knock body, with a front end thereof being in contact with a back end of the pressurizing mechanism;

a first spring body is disposed between an outer step part of the ballpoint refill and an inner step part of the shaft tube so that the ballpoint refill is elastically urged to the back side with respect to the shaft tube;

by pushing the knock body of the projecting and retracting mechanism to the front side, an engagement part formed on an outer wall of the slide member is engaged with an engaged part on a front part of a clip provided on a back part of the shaft tube so that the front end part of the ballpoint refill is maintained to project from the front end opening of the shaft tube, and by pushing the back end part of the clip so as to disengage the engagement state between the engagement part and the engaged part of the clip, the slide member is moved to the back side by a spring force of the first spring body so that the front end part of the ballpoint refill is retracted into the front end opening of the shaft tube; and while the front end part of the ballpoint refill is maintained to project from the front end opening of the shaft tube, the pressurized mechanism is actuated by the ballpoint refill which is moved to the back side by a writing pressure upon writing so as to apply a pressure to the back end of the writing implement ink composition, and the pressure applied to the back end of the writing implement ink composition is configured to be adjustable by rotating the knock body of the projecting and retracting mechanism so as to move the slidable member in the back and forth direction.

In the pressurized-type writing implement of the present invention, the pressurizing mechanism may comprise a cylinder connected to a back end part of the ink storage tube and having an air hole communicating an inside and an outside with each other, a piston disposed in a back end opening of the cylinder so as to be movable in the back and forth direction with respect to the cylinder, a sealing member that closes the air hole of the cylinder, a second spring body disposed between the cylinder and the piston so as to elastically urge the cylinder to the front side, and the pressurized chamber formed between an inner wall of the cylinder and a front end of the piston so as to be in communication with the back end opening of the ink storage tube; and in a not-knocked state in which the ballpoint refill is in the shaft tube, a spring force of the first spring body may be configured to be smaller than a spring force of the second spring body.

In the pressurized-type writing implement of the present invention, in a knocked state in which the knock body is pushed to the front side so that the ballpoint refill is projected from the front end opening of the shaft tube, the spring force of the first spring body may be configured to be larger than the spring force of the second spring body.

In the pressurized-type writing implement of the present invention, in a knocked state in which the knock body is pushed to the front side so that the ballpoint refill is projected from the front end opening of the shaft tube, the spring force of the first spring body may be configured to be smaller than the spring force of the second spring body.

In the pressurized-type writing implement of the present invention, the writing implement ink composition may be a thermochromic ink; and a friction body may be provided on the back end of the shaft tube, the friction body being capable of frictioning a handwriting of the thermochromic ink so as to discolor the handwriting by a frictional heat generated upon frictioning.

According to the present invention, a pressurized-type writing implement is provided, which is capable of pressurizing an inside of an ink storage tube at a given pressurizing force in accordance with a user's taste by rotating a knock body, and is capable of, once a pressurizing force has been set, easily switching a writing state and a not-writing state upon use.

DETAILED DESCRIPTION OF THE INVENTION

Figure 1:
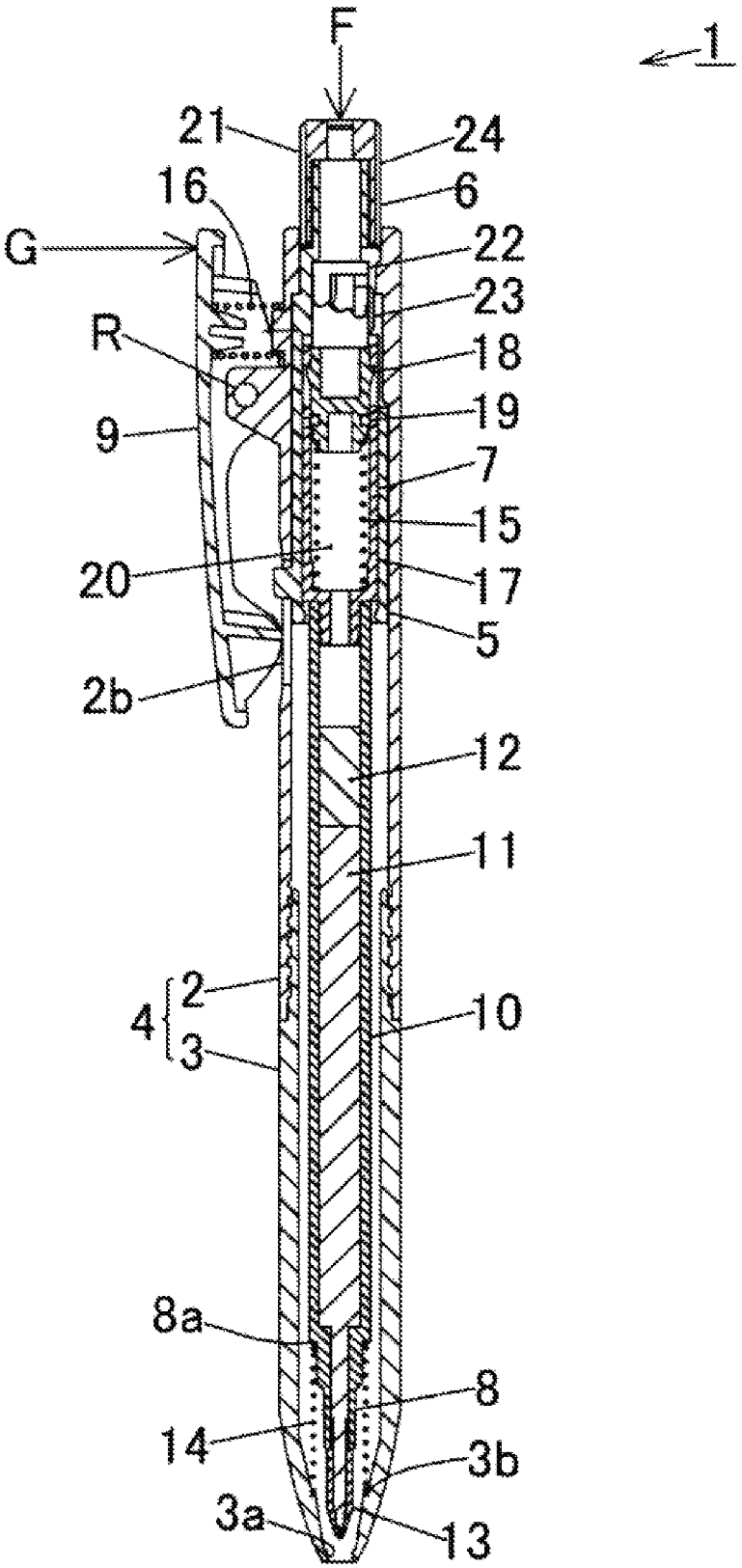
FIG. 1 is a longitudinal sectional view of a pressurized-type writing instrument in a first embodiment.

A pressurized-type writing implement of the present invention will be hereafter described in detail, but the present invention is not limited to the below respective embodiments.

In this specification, in a longitudinal direction of a shaft tube, a side with a ballpoint pen tip is referred to as front (forward/forth) and an opposite side is referred to as back (backward). In accordance therewith, a direction along the longitudinal direction of the shaft tube is sometimes referred to as back and forth direction. Movement in the back and forth direction is sometimes referred to as backward/forward movement. Further, in a shaft diameter direction of the shaft tube, a side with a ballpoint refill is referred to as inside/inward/inner, and an opposite side is referred to as outside/outward/outer.

With a view to facilitating description, similar members or similar components in the drawings have the same reference number.

First Embodiment

A pressurized-type writing implement 1 in this embodiment comprises a shaft tube 4, a pressurizing mechanism 7, and a pressurizing-force adjusting mechanism 24. The shaft tube 4 is configured to be capable of housing therein a refill 8 filled with an ink 11 that is a writing implement ink composition. The pressurizing mechanism 7 is a mechanism that applies a pressure to the ink 11. The pressurized-type writing implement 1 is configured to be capable of switching between a writing state in which a front end part of the refill 8 projects from a front end opening 3*a* of the shaft tube 4, and a not-writing state in which the front end part of the refill 8 is retracted from the front end opening 3*a* of the shaft tube 4. In the pressurized-type writing implement 1 shown in FIGS. 1 to 5, the shaft tube 4 is formed by threadedly engaging a front shaft 3 to a front part of a back shaft 2. The pressurized-type writing implement 1 is composed of a slide member 5 disposed in the shaft tube 4 so as to be movable in the back and forth direction, a knock body 6 locked on a back part of the slide member 5, the pressurizing mechanism 7 disposed in the slide member 5, the refill (ballpoint refill) 8 mounted on a front part of the pressurizing mechanism 7 so as to be slidable in the back and forth direction in the shaft tube 4, and a clip 9 rotatably locked on a side surface of the back shaft 2.

The ballpoint refill 8 is obtained by directly housing, in a transparent ink storage tube 10 made of a PP resin, the ink 11 which is an ink composition for writing implement and a grease-like ink follower 12 at a back end of the ink 11, the ink follower 12 following the ink 11 as it is consumed, and by press-fitting a back end of part of a ballpoint tip 13 rotatably holding a ball (ϕ 0.38 mm) into a front end opening of the ink storage tube 10.

As shown in FIG. 1, the front shaft 3 (shaft tube 4) has, at its front end, the front end opening 3*a* from which the ballpoint tip 13 of the ballpoint refill 8 can project. In addition, a first coil spring 14 (first spring body) in a compressed state is extended between an inner step part 3*b* formed on an inner surface of the front shaft 3 (shaft tube 4) and an outer step part 8*a* formed on an outer circumferential surface of the ballpoint refill 8 so as to elastically urge the ballpoint refill 8 to the back side with respect to the shaft tube 4.

Figure 2:
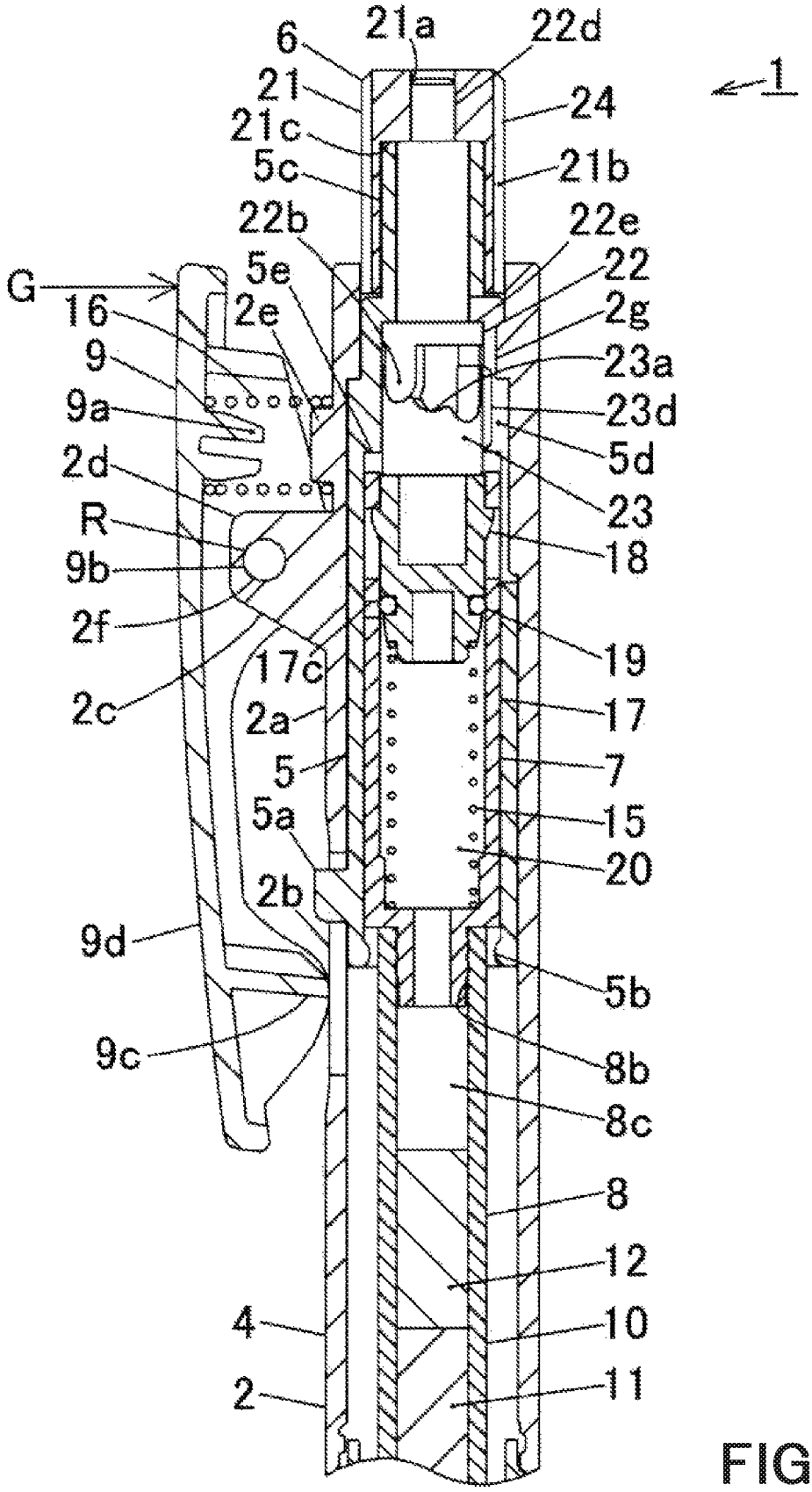
FIG. 2 is an enlarged longitudinal sectional view in which a main part of FIG. 1 is enlarged.

The back shaft 2 (shaft tube 4) is formed to have a cylindrical shape. As shown in FIG. 2, an outside surface 2*a* has a side hole 2*b* which extends along an axial direction to pass through an inner hole. In addition, the outside surface 2*a* has a clip locking part 2*c* which projects outward. The clip locking part 2*c* is composed of a clip locking projection 2*d* and a spring locking projection 2*e*. The clip locking projection 2*d* has a locking hole 2*f* in a direction orthogonal to the axial direction.

A rail part 2*g* that projects inward and extends axially is formed on an inner circumferential part of the back shaft 2.

Figure 3:
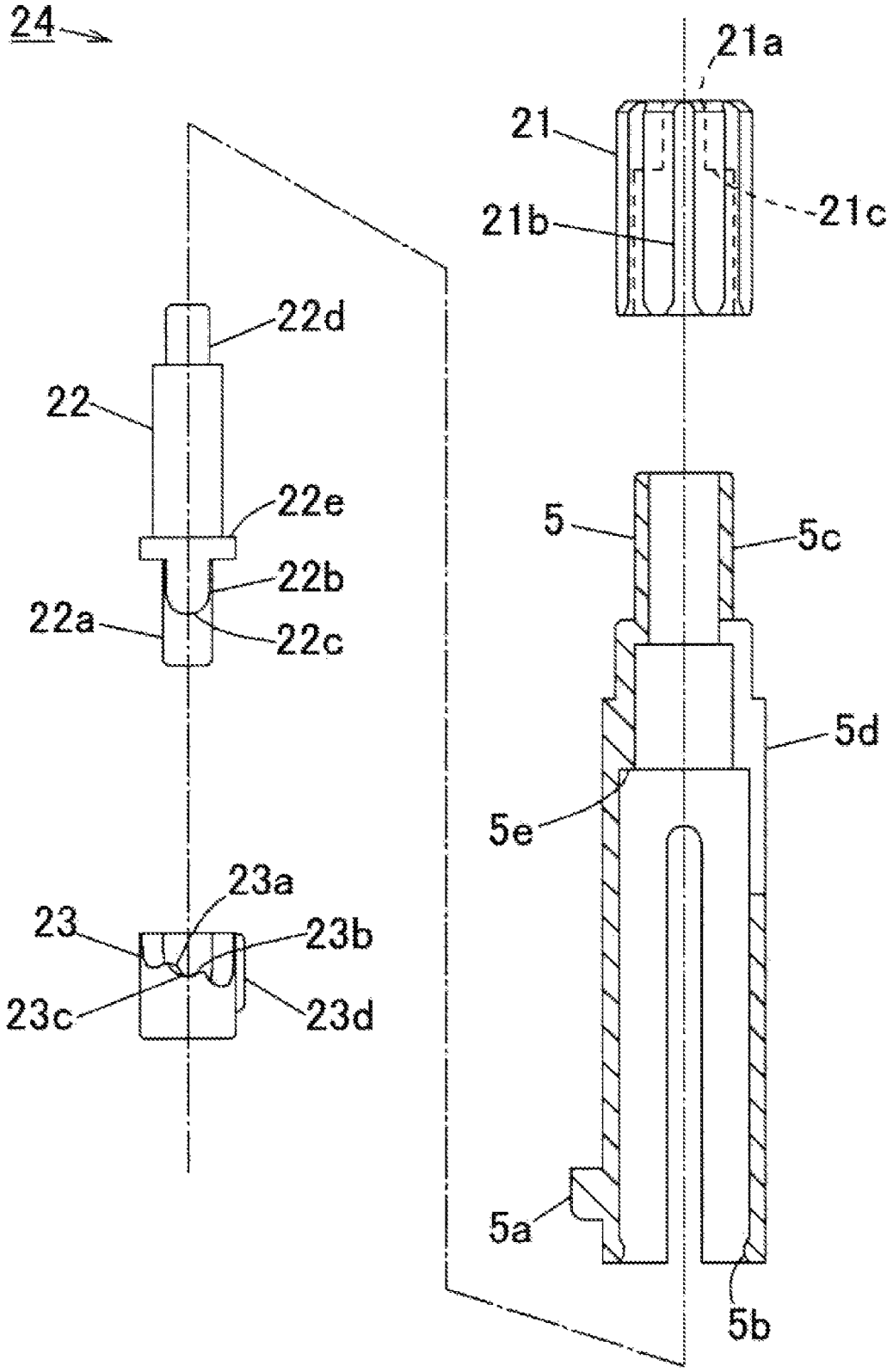
FIG. 3 is an exploded view for describing a structure of a pressurizing-force adjusting mechanism.

As shown in FIGS. 1 to 3, the slide member 5 has on its outer circumferential part an engagement projection 5*a* that projects outward. By positioning the engagement projection 5*a* in the side hole 2*b* of the back shaft 2, the slide member 5 is mounted on the back shaft 2 so as to be slidable in the back and forth direction and unrotatable.

In addition, a front inner hole of the slide member 5 has a plurality of projecting stoppers 5*b* that project inward, and a back step part 5*c* having a smaller internal diameter is formed on a back end of the slide member 5.

Further, the slide member 5 has on its back outside surface a cam side hole 5*d* that extends along the axial direction.

As shown in FIGS. 1 and 2, the clip 9 has a clip spring 16 disposed between the spring locking projection 2*e* of the back shaft 2 and an inner projection 9*a* formed on an inner wall part of the clip 9 so as to project toward the shaft tube 4. A locking shaft part 9*b* formed on an inside wall of the clip 9 is locked in the locking hole 2*f*, so that a distal end part of the clip 9 is elastically urged invariably onto an outer wall surface of the back shaft 2. In addition, the clip 9 is configured as a movable clip such that, by pushing a back end part of the clip 9 (in a direction shown by the arrow G in FIG. 2), the distal end part of the clip 9 can be moved away from the outer wall surface of the back shaft 2 with a locking axis R between the clip 9 and the back shaft 2 serving as a fulcrum point.

The clip 9 has on its front part an engaged part 9*c* extending from a proximal part 9*d* toward the shaft tube 4 so as to be engaged with the engagement projection 5*a* formed on the side surface of the slide member 5.

Figure 4:
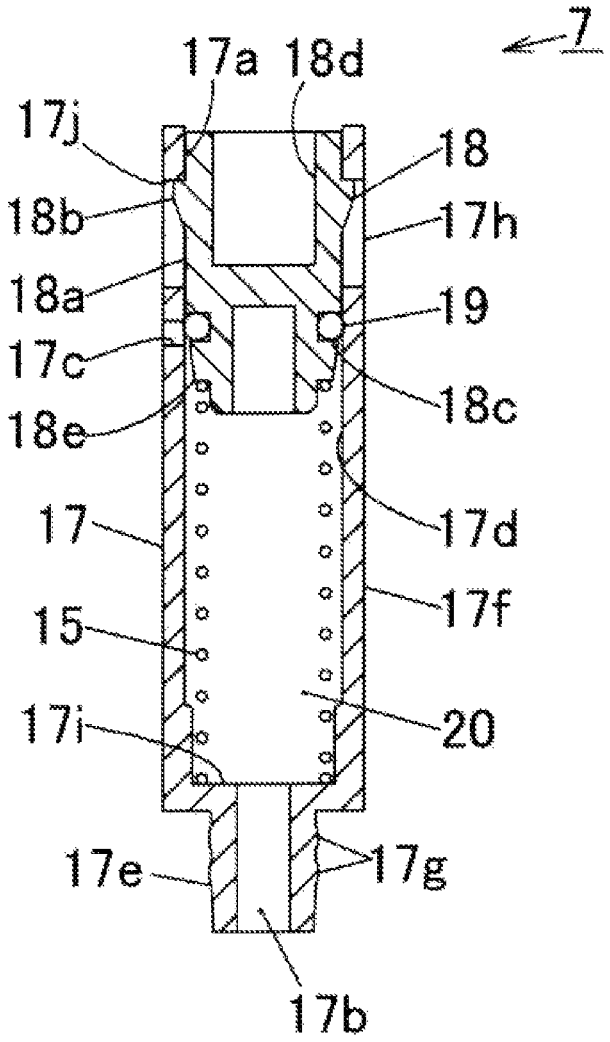
FIG. 4 is a longitudinal sectional view of a pressurization mechanism.

As shown in FIGS. 1, 2 and 4, the pressurizing mechanism 7 is housed on the back side of the ballpoint refill 8 and inward the slide member 5 so as to be slidable in the back and forth direction with respect to the slide member 5. The pressurizing mechanism 7 is composed of a cylindrical cylinder 17, a piston 18 inserted in a back end opening 17*a* of the cylinder 17 and disposed so as to be slidable in the back and forth direction with respect to the cylinder 17, an O-ring 19 fitted on a side surface of the piston 18, and a second coil spring (second spring body) 15 extended between the cylinder 17 and the piston 18.

A forward movement of the pressurizing mechanism 7 is restricted by the stoppers 5*b* of the slide member 5.

The cylinder 17 is described in detail. As shown in FIG. 4, the cylinder 17 has a stepped inner hole 17*b* passing therethrough in the back and forth direction. An air hole 17*c* passing through to the inner hole 17*b* is formed in an outer circumferential surface of the cylinder 17.

In addition, in the inner hole 17*b* of the cylinder 17, a pressurized space 20 (pressurized chamber), which is surrounded by an inside part 17*d* of the cylinder 17, a front end of the piston 18 and the O-ring 19, is formed. The pressurized space 20 is in ventilatory communication with the outside of the cylinder 17 through the air hole 17*c*.

Further, a front part 17*e* of the cylinder 17 has a diameter smaller than that of a central part 17*f*. The front part 17*e* has two fixing parts 17*g* along the axial direction. The fixing part 17*g* circumferentially projects outward. In addition, a back end inner circumferential part 8*b* of the ballpoint refill 8 is removably fixed on the fixing parts 17*g* of the cylinder 17. The pressurized space 20 is in communication with a back inner hole 8*c* of the ballpoint refill 8 through the inner hole 17*b* of the cylinder 17.

An outward projection amount (external diameter) of the fixing part 17*g* is adjusted such that, when the ballpoint refill 8 is fixed on the cylinder 17, airtightness between the cylinder 17 and the ballpoint refill 8 is ensured, and that the ballpoint refill 8 can be easily removed by hand.

For example, when the ballpoint refill 8 is attached to the cylinder 17, a force applied thereto is 10 N.

The piston 18 is described in detail. The piston 18 has on its outer circumferential part 18*a* two protrusions 18*b* projecting outward, which are arranged symmetrically with respect to a shaft center. The protrusions 18*b* are locked on a window part 17*h* so as to be slidable in the back and forth direction. The window part 17*h* is formed on the central part 17*f* of the cylinder 17 so as to extend along the shaft center.

The outer circumferential part 18*a* of the piston 18 has a recessed concave part 18*c* extending in an axially circumferential direction. An O-ring (sealing member) 19 made of a synthetic rubber is fitted in the concave part 18*c*. An outside part of the O-ring 19 is in slidable contact with the inside part 17*d* of the cylinder 17. The back end opening 17*a* of the cylinder 17 is air-tightly sealed by the piston 18 and the O-ring 19. In addition, a back end surface of the piston 18 has a back inner hole 18*d* formed to be recessed to the front side.

When the cylinder 17 is moved to the back side, the back end of the cylinder 17 comes into contact with the inner step part 5*e* of the slide member 5, so that the backward movement of the cylinder 17 is restricted.

The second coil spring 15 (second spring body) is described in detail. The second coil spring 15 is extended between an inner step part 17*i* of the cylinder 17 and a front step part 18*e* of the piston 18 so as to elastically urge the cylinder 17 to the front side with respect to the piston 18.

When the cylinder 17 is slid in the back and forth direction so that the O-ring 19 is positioned on the front side of the air hole 17*c* of the cylinder 17, the pressurized space 20 is hermetically sealed. When the O-ring 19 is positioned on the back side of the air hole 17*c*, the pressurized space 20 and the outside of the cylinder 17 are in ventilatory communication with each other through the air hole 17*c*, and is not hermetically sealed.

Next, the knock body 6 is described in detail. As shown in FIGS. 1 to 3, the knock body 6 is composed of a cylindrical knob 21 and a rod-like front member 22. In the illustrated example, the knock body 6 is disposed to project from the back end of the shaft tube 4.

The front member 22 has on its outside surface a projection 22*b* projecting outward. The projection 22*b* has on its front end an arcuate locking part 22*c*.

By inserting a back part 22*d* into a back inner hole 21*a* of the knob 21, the front member 22 and the knob 21 are irremovably press-fitted.

The knob 21 has on its outside surface a plurality of groove parts 21*b* which extend in the shaft center direction at equal intervals therebetween. Due to the groove parts 21*b*, the knock body 6 is not slippery when grasped by hand.

In addition, in the knocked state in which the knock body 6 is pushed to the front side, the groove parts 21*b* are locked in the rail parts 2*b* of the back shaft 2 so that the knock body 6 becomes unrotatable.

When the front member 22 and the knob 21 are press-fitted, the back step part 5*c* having a smaller diameter, which is formed on the back part of the slide member 5, is disposed between the step part 22*e* formed on the side surface of the front member 22 and the inner step part 21*c* of the knob 21. Thus, the knock body 6 is locked so as to be rotatable with respect to the slide member 5. Thus, the knock body 6 together with the slide member 5 is configured to be slidable in the back and forth direction with respect to the shaft tube 4.

In addition, a cam member 23 formed to have a cylindrical shape is disposed between the projection 22*b* of the front member 22 and the back end of the piston 18. The cam member 23 has a cam slant 23*a* which inclines to the front side from a back end surface. The cam slant 23*a* has a step-like shape with a plurality of step parts 23*b*. In the illustrated example, the cam member 23 is locked so be slidable in the back and forth direction with respect to the knock body 6 (front member 22). The back end of the piston 18, which is elastically urged to the back side by the second coil spring 15, is in contact with the front end of the cam member 23 so as to elastically urge the cam member to the back side. Since the cam slant 23*a* is in contact with the locking portion 22*c* of the projection 22*b* of the front member 22, the backward movement of the cam member 23 is restricted.

The step part 23*b* of the cam member 23 has a concave part 23*c* formed by a curved surface that is recessed to the front side in the axial direction. By matching curvatures of the concave part 23*c* and the locking part 22*c* of the projection 22*b* of the front member 22, the cam member 23 and the front member 22 are securely locked.

Further, the cam member 23 has on its outer circumferential surface a slidable projection 23*d* that projects outward and extends in the back and forth direction. By inserting the slidable projection 23*d* in the cam side hole 5*d* of the slide member 5 so as to be slidable in the back and forth direction, the cam member 23 is fixed on the slide member 5 so as to be slidable in the back and forth direction and is unrotatable.

The slide member 5, the knock body 6 and the cam member 23 constitute the pressurizing-force adjusting mechanism 24. By rotating the knock body 6, the cam member 23 is moved in the back and forth direction.

A relationship between spring forces of the first coil spring 14 and the second coil spring 15 is described.

Figure 5:
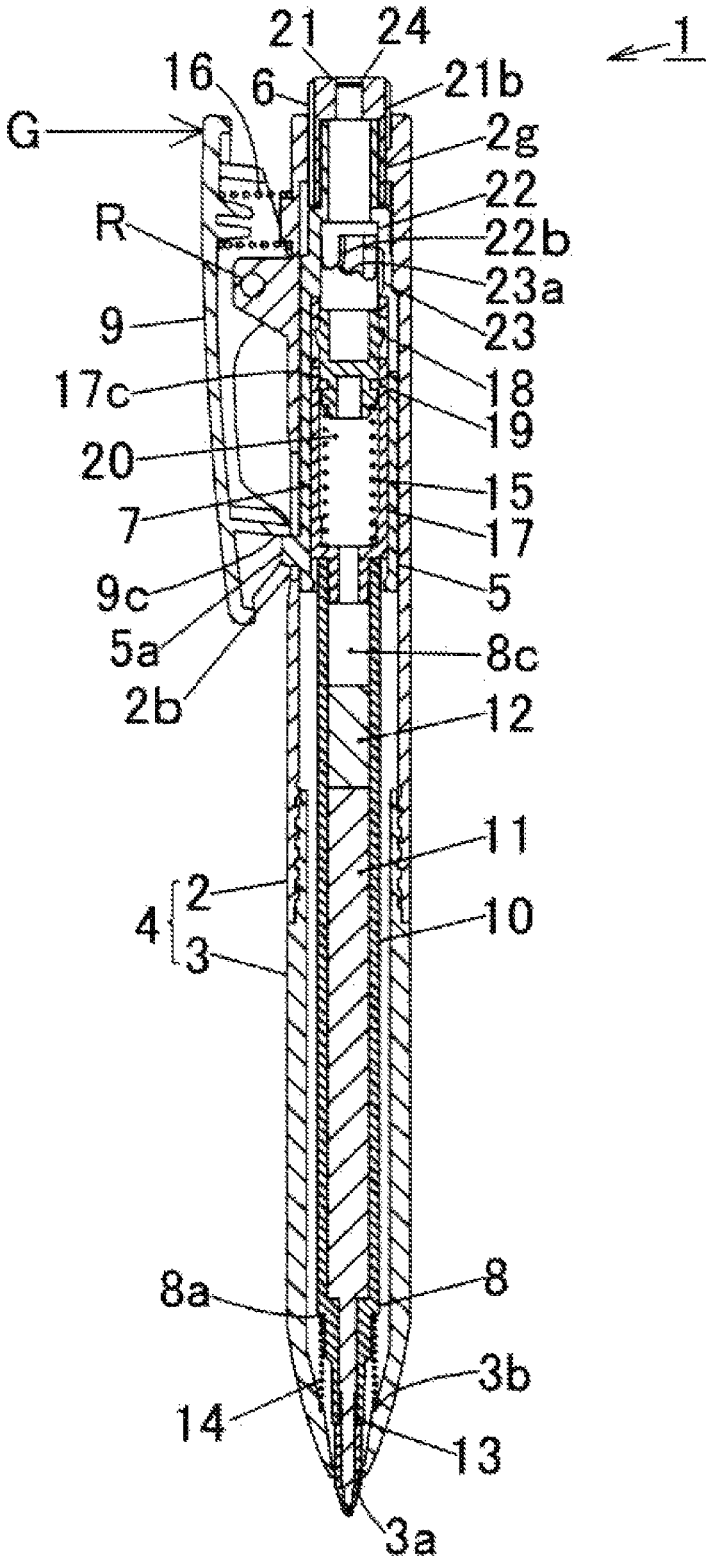
FIG. 5 is a longitudinal sectional view showing a state in which a knock body is pushed from the state of FIG. 1.

The spring forces of the respective coil springs are adjusted such that, in the not-knocked state in FIG. 1, the spring force of the first coil spring 14 is smaller than the spring force of the second coil spring 15, and that, in the state (knocked state) of FIG. 5 in which the knock body 6 is pushed to the front side, the spring force of the first coil spring 14 is larger than the spring force of the second coil spring 15.

Next, with reference to FIGS. 1 and 5, there is described a state in which, by pushing the knock body 6 to the front side (knocking operation), the ballpoint tip 13 as a writing distal end of the ballpoint refill 8 projects or retracts from the front end opening 3*a* of the front shaft 3, and a pressure is applied to the back end of the ink 11 in the ballpoint refill 8 through the ink follower 12.

When the knock body 6 is pushed to the front side (in a direction shown by the arrow F in FIG. 1) from the state of FIG. 1, the slide member 5 and the piston 18 and the piston 18 are pressed by the knock body 6 through the com member 23 so as to move to the front side. At this time, in the not-knocked state, the spring force of the second coil spring 15 is set larger than the spring force of the first coil spring 14. Thus, the cylinder 17 and the ballpoint refill 8 are pushed to the front side so as to move to the front side, with the second coil spring 15 not being compressed and with the pressurized space 20 not being pressurized. Then, the first coil spring 14 is pushed by the ballpoint refill 8 so as to be compressed, so that the spring force of the first coil spring 14 becomes larger than the spring force of the second coil spring 15, whereby the forward movement of the cylinder 17 stops. Further, when the knock body 6 together with the slide member 5 moves to the front side so that the inner step part 5*e* of the slide member 5 comes into contact with the back end of the cylinder 17, the cylinder 17 together with the ballpoint refill 8 is pushed again by the knock body 6 to move to the front side. Thus, the front end of the ballpoint tip 13 projects from the front end opening 3*a* of the front shaft 3. Then, the engagement projection 5*a* of the slide member 5 is engaged with the engaged part 9*c* of the distal end of the clip 9 disposed on the side surface of the back shaft 2. Thus, the front end of the ballpoint tip 13 is maintained to project from the front end opening 3*a* of the front shaft 3 (shaft tube 4), which is shown in FIG. 5.

At this time, in the pressurizing mechanism 7, when the forward movement of the cylinder 17 stops, the piston 18 moves to the front side with respect to the cylinder 17 so as to contract the second coil spring 15, so that the position of the O-ring 19 is moved to the front side of the air hole 17*c* of the cylinder 17, whereby the pressurized space 20 is hermetically sealed by the O-ring 19. When the piston 18 is further moved to the front side, the second coil spring 15 is further compressed so as to compress the back inner hole 8*c* of the ballpoint refill 8 and the pressurized space 20. Namely, since the volume of the pressurized space 20 is reduced, a pressure is applied to the back end of the ink 11 in the ballpoint refill 8 through the ink follower 12. In this case, the pressurized-type writing implement 1 is adjusted such that the volume of the pressurized space (pressurized chamber) 20 is decreased by rotating the knock body 6 both upon writing and upon not-writing.

Then, by pushing the back end part of the clip (in a direction shown by the arrow G in FIG. 6) to disengage the engagement state of the engagement projection 5*a* of the slide member 5 and the engagement part 9*c* of the clip 9, the ballpoint refill 8, the cylinder 17, the piston 18 and the knock body 6 are moved to the back side by the spring force of the first coil spring 14. Thus, the front end of the ballpoint tip 13 is retracted into the front end opening 3*a* of the front shaft 3, and the compressed state of the pressurized space 20 is released by the second coil spring 15, so as to return to the not-knocked state shown in FIG. 1.

Figure 6A:
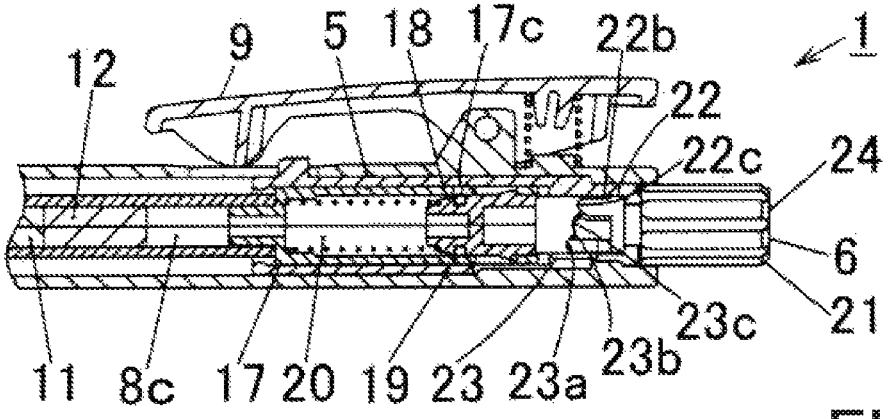
FIG. 6A is an explanatory view showing a state in which the knock body is rotated, with a pressurizing force being set at a relatively high pressure.
Figure 6B:
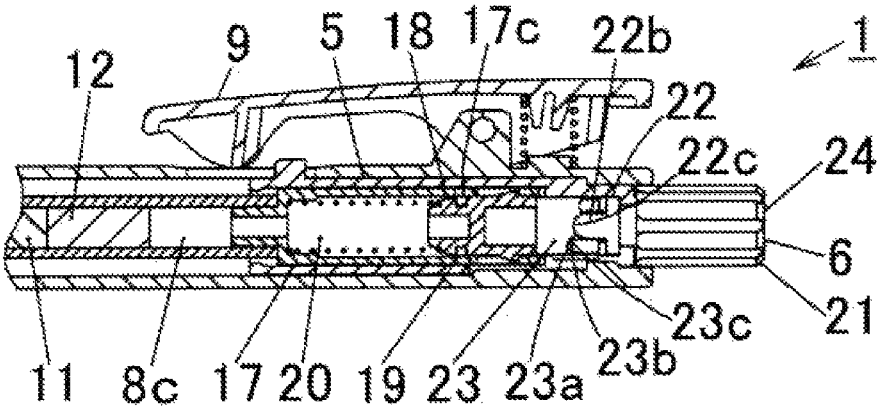
FIG. 6B is an explanatory view showing a state in which the knock body is rotated, with a pressurizing force being set at a relatively low pressure.
Figure 6C:
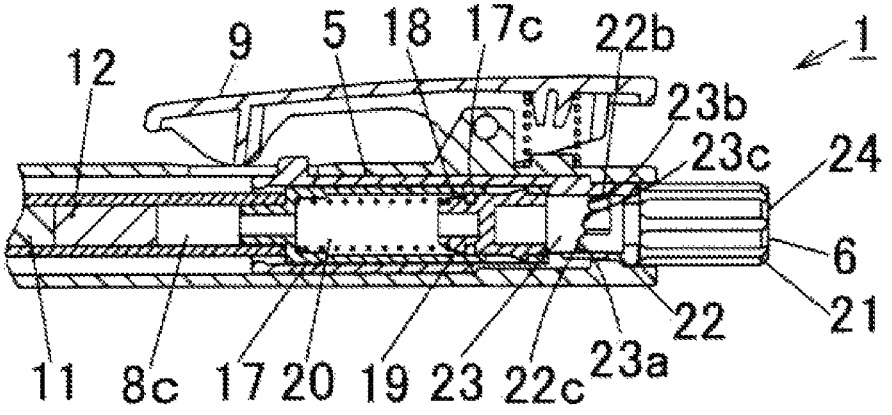
FIG. 6C is an explanatory view showing a state in which the knock body is rotated, with no pressurizing force being set to be applied.

Further, in this embodiment, during the not-knocked state shown in FIG. 1, by rotating the knock body 6 with respect to the back shaft 2, the pressurizing force applied to the ink 11 can be adjusted. By rotating the knock body 6 from the state of FIG. 6A, a contact position between the projection 22*b* of the front member 22 and the step part 23*b* of the cam member 23 is shifted stepwise as shown in FIGS. 6B and 6C, so as to shorten a distance between the projection 22*b* of the front member 22 and the piston 18. Thus, an advancement position of the piston 18 with respect to the slide member 5 when the knock body 6 is pushed to the front side can be moved to the back side. As a result, in the pressurizing-force adjusting mechanism 24 in this embodiment, by rotating the knock body 6 to move the cam member 23 to the front side or to the back side, the volume of the pressurized space 20 decreased or increased. In this embodiment, since the pressurized space 20 is adjusted not to be compressed at all in the state of FIG. 6C, the pressurized-type writing implement 1 can be used as a general non-pressurized-type writing implement.

In addition, when the knock body 6 is rotated so that the locking part 22*c* of the projection 22*b* of the front member 22 and the concave part 23*c* of the cam member 23 are locked, a locking sound is generated. Thus, a user can recognize that a pressurizing force is varied stepwise haptically and audibly.

In addition, as described above, when the knock body 6 is moved to the front side, the groove parts 21*b* of the knob 21 are locked in the rail parts 2*g* of the back shaft 2. Thus, during the knocked state (writing state), the rotation of the knock body 6 is enabled. Consequently, it can be prevented that the knock body 6 is rotated without a user's intention during writing, whereby writing can be stabled.

In this embodiment, while the locking part 22*c* and the concave part 23*c* are locked, positions of the rail parts 2*g* and the groove parts 21*b* seen from the axial direction correspond to each other. Even when the knock body 6 is rotated so that the locking part 22*c* is locked in another concave part, the groove parts 21*b* are locked in the rail parts 2*g* without contact upon knocking.

Due to the above structure, in this embodiment, the knock body 6 is rotated to actuate the pressurizing-force adjusting mechanism 24 so as to switch a pressurizing force setting, and the knock body 6 can be pushed in this state. Thus, it is possible to provide the pressurized-type writing implement 1 capable of easily switching a writing state and a not-writing state by a knocking operation while maintaining a set pressuring force applied to the ink 11.

In the pressurized-type writing implement 1, the front shaft 3 can be detached from the back shaft 3 by rotating the front shaft 3 with respect to the back shaft 2. Under this state, when the ballpoint refill 8 is pulled to the front side, the ballpoint refill 8 can be drawn out from the cylinder 17 which cannot be moved to the front side by the stoppers 5*b* of the slide member 5, so that the ballpoint refill 8 can be easily replaced. Further, since it is easy to take out the first coil spring 14 from the front shaft 3, the first coil spring 14 can also be replaced.

At this time, by replacing the first coil spring 14 with a first coil spring 34 having a smaller spring force such that the spring force of the first coil spring 14 is higher than the spring force of the second coil spring 15 during the knocked state, the pressurized-type writing implement 1 can be changed from the knock pressure type into the wiring pressure type.

The pressurized-type writing implement 1 in this embodiment comprises a shaft tube 4 capable of housing therein a refill 8 filled with a writing implement ink composition 11, and a pressurizing mechanism 7 that applies a pressure to the writing implement ink composition 11, the pressurized-type writing implement 1 being capable of switching a writing state in which a front end part of the refill 8 projects from a front end opening 3*a* of the shaft tube 4, and a not-writing state in which the front end part of the refill 8 is retracted from the front end opening 3*a* of the shaft tube 4, wherein the pressurized-type writing implement 1 has a pressurizing-force adjusting mechanism 24 that adjusts the pressure.

According to such a pressurized-type writing implement 1, in the pressurized-type writing implement 1 capable of switching the writing state and the not-writing state, a pressure acting on the writing implement ink composition 11 filled in the refill 8 can be adjusted in accordance with a user's taste. For example, when the pressurized-type writing implement 1 is adjusted such that a pressure acts on the writing implement ink composition 11 as shown in FIG. 6B, an amount of the writing implement ink composition 11 to be deposited on a writable surface such as a paper sheet can be increased, as compared with a case in which the pressurized-type writing implement 1 is adjusted such that on pressure acts on the writing implement ink composition 11. Thus, the handwriting of the pressurized-type writing implement 1 can be darkened and/or thickened. In addition, when the pressurized-type writing implement 1 is adjusted such that a higher pressure acts on the writing implement ink composition 11 as shown in FIG. 6A, an amount of the writing implement ink composition 11 to be deposited on a writable surface such as a paper sheet can be further increased, as compared with the case shown in FIG. 6B. Thus, the handwriting of pressurized-type writing implement 1 can be further darkened and/or further thickened.

In the pressurized-type writing implement 1 of this embodiment: a ballpoint refill 8 is housed in a shaft tube, wherein the ballpoint refill 8 includes an ink storage tube 10 filled with a writing implement ink composition 11, and a ballpoint tip on a front part of the ink storage tube 10; a pressurized chamber 20 and a pressurizing mechanism 7 that applies a pressure to the pressurized chamber are disposed on a back side of the ballpoint refill 8, wherein the pressurized chamber 20 is in communication with a back end of the writing implement ink composition 11; and a front end of the ballpoint refill 8 is configured to project from a front end opening 3*a* of the shaft tube 4 by pushing a knock body 6 disposed on the back side of the pressurizing mechanism 7; characterized in that: a cam member is disposed on the front side of the knock body 6; a pressurizing-force adjusting mechanism 24 is disposed on the back side of the pressurizing mechanism 7, wherein the pressurizing-force adjusting mechanism 24 increases or decreases a volume of the pressurized chamber 20, at least during writing, by rotating the knock body 6; a first spring body 14 is disposed between an outer step part 8*a* of the ballpoint refill 8 and an inner step part 3*b* of the shaft tube 4, so as to elastically urge the ballpoint refill 8 to the back side with respect to the shaft tube 4; and when the knock body 6 is pushed to the front side or the ballpoint refill 8 is moved to the back side by a writing pressure upon writing, the pressurizing mechanism 7 is actuated so as to apply a pressure to the back end of the writing implement ink composition 11, the pressure applied to the back end of the writing implement ink composition 11 is configured to be adjustable by the pressurizing-force adjusting mechanism 24.

According to such a pressurized-type writing implement 1, the writing state and the not-writing state can be easily switched by pushing the knock body 6 to the front side (knocking operation). Further, when the pressurizing-force adjusting mechanism 24 is actuated by rotating the knock body 6 so as to adjust the pressure applied to the back end of the writing implement ink composition 11, a handwriting thickness and a handwriting density can be adjusted in accordance with a user's taste.

In addition, as means for actuating the pressurizing mechanism 7 that applies a pressure to the back end of the writing implement ink composition 11, it is possible to employ a knock pressure type in which the pressurizing mechanism 7 is actuated by pushing knock body, or a writing pressure type in which the pressurizing mechanism 7 is actuated by a writing pressure upon writing.

As the locking means for locking the knock body 6 and the cam member 23, the following structure is possible. The projection 22*b* projecting outward is formed on a side surface of the knock body 6, that the cam slant 23*a* is formed on the back part of the cam member 23, and the rotation of the knock body 6 slides the projection 22*b* along the cam slant 23*a* so that the cam member 23 is moved in the back and forth direction. Alternatively, the following structure is possible. a cam slant is formed on a front surface of the knock body 6, a projection projecting outward is formed on a side surface of the cam member 23, and the rotation of the knock body 6 slides the cam slant with respect to the projection so that the cam member 23 is moved in the back and forth direction.

As long as the cam member 23 can push the pressurizing mechanism 7 by the back and forth movement of the cam member 23, the cam member 23 may be in contact with the pressurizing mechanism 7 or may be integrally formed with a part of the pressurizing mechanism 7.

When a cam structure is used as locking means for locking the knock body 6 and the cam member 23, it is preferable that the cam member 23 or the cam slant formed on the knock body 6 has a plurality of step parts. Since a pressurizing force upon rotation of the knock body 6 can be adjusted stepwise, a user can easily adjust the pressurizing force.

Further, a display unit may be provided on an outer surface of the knock body 6. When a step part and the projection 22*b* of the knock body 6 come into contact with each other, a state in which the display unit of the knock body 6 and a display unit provided on the outer surface of tube shaft 4 may express a pressurizing force level.

A plurality of the step parts 23*b* may have the concave part 23*c* that is concave to the front side or the back side. In this case, since the distal end of the projection 22*b* locks with the concave part 23*c*, the knock body 6 cannot be easily rotated. Thus, it can be prevented that a set pressurizing force is changed without a user's intention.

It is preferable that a sound is generated when the projection 22*b* and the concave part 23*c* are locked with each other, in order to recognize that a pressurizing force has been switched.

In the pressurized-type writing implement 1 in this embodiment; a slide member 5, which is movable in a back and forth direction with respect to the shaft tube 4, is disposed outside the knock boy 6, the knock body 6 is locked so as to be rotatable and immovable in the back and forth direction with respect to the slide member 5, and the cam member 23 is locked so as to be movable in the back and forth direction and unrotatable with respect to the slide member 5 and; the slide member 5, the knock body 6 and the cam member 23 constitute the pressurizing-force adjusting mechanism 24.

According to such a pressurized-type writing implement 1, an operation for projecting and retracting the ballpoint refill 8 by moving the knock body 6 in the back and forth direction (knocking operation), and an operation for actuating the pressurizing-force adjusting mechanism 24 by the rotation of the knock body 6 so as to adjust a pressurizing force, can be performed separately from each other. Thus, the writing state and the not-writing state can be easily switched without adjusting a pressurizing force each time.

In the pressurized-type writing implement 1 in this embodiment, the pressurizing mechanism 7 comprises the cylinder 17 connected to the back end of the ink storage tube 10 and having the air hole 17*c* communicating the inside and the outside with each other, the piston 18 disposed in the back end opening 17*a* of the cylinder 17 so as to be movable in the back and forth direction with respect to the cylinder 17, the sealing member 19 that closes the air hole 17*c* of the cylinder 17, the second spring body 15 disposed between the cylinder 17 and the piston 18 so as to elastically urge the cylinder 17 to the front side, and the pressurized chamber 20 formed between the inner wall of the cylinder 17 and the front end of the piston 18 so as to be in communication with the back end opening of the ink storage tube 17*a*, and in the not-knocked state in which the ballpoint refill 8 is in the shaft tube 4, a spring force of the first spring body 14 is configured to be smaller than a spring force of the second spring body 15.

According such a pressurized-type writing implement 1, in the not-knocked state, since the cylinder 17 is pushed to the front side by the second spring body (second coil spring) 15, no pressure is applied to the writing instrument ink composition 11. Thus, ink leakage from the distal end of the ballpoint tip 13 can be prevented.

In the pressurized-type writing implement 1 in this embodiment, in the knocked state in which the knock body 6 is pushed to the front side so that the ballpoint refill 8 is projected from the front end opening 3*a* of the shaft tube 4, the spring force of the first spring body 14 is configured to be larger than the spring force of the second spring body 15.

According to such a pressurized-type writing implement 1, when the ballpoint refill 8 pushed to the back side by the first spring body (first coil spring) 14 pushes the cylinder 17, the pressurized chamber (pressurized space) 20 in the cylinder 17 is pressurized. Thus, since the writing implement ink composition 11 is quickly pressurized by the knocking operation, the pressurized-type writing implement 1 can be used as a knock pressure-type writing implement capable of writing with a pressurizing force being increased from the start of writing.

In the knock pressure-type, in the knocked state in which the knock body 6 is pushed to the front side, the knock body 6 may be configured to be unrotatable. In this case, it can be prevented that, when a hand or the like touches the knock body 6, the knock body 6 is rotated without a user's intention. Thus, the pressure applied to the back end of the writing implement ink composition is unchanged, whereby it is enabled to write with a stable handwriting.

Further, in the knock pressure-type, the writing implement ink composition 11 in the ballpoint refill 8 gradually decreases by continuous writing. Thus, the pressurizing force applied to the back end of the writing implement ink composition 11 lowers. Since the knock body 6 is rotatable in the knocked state, the pressure lowered during writing can be increased again still in the knocked state.

With a pressure in the pressurized chamber (pressurized space) 20 being lowered by writing, when the knock body 6 is rotated in a direction in which the pressure further lowers, the inside of the pressurized chamber has a negative pressure as compared an outside air. Thus, there is a possibility that air enters from the distal end of the ballpoint refill 8 into the ballpoint refill 8 so that the ink 11 cannot move to the front side because of the air. Thus, it is preferable that the knock body 6 is rotated only in a direction in which a pressure increases.

The aforementioned first embodiment can be variously modified. Herebelow, a modification example is described with reference to the drawings according to need. In the below description and the drawings used in therein, the same reference number is used to a part that can be similarly structured as the first embodiment, and overlapped description is omitted. When it is apparent that the same effect obtained in the first embodiment is obtained in the modification example, the description is sometimes omitted.

In a pressurized-type writing implement 30 in this modification example, in an attachment state (not-knocked state) of FIGS. 6A to 6C, a spring force of the first coil spring 34 and a spring force of the second coil spring 15 are adjusted such that the spring force of a first coil spring 34 is smaller than the spring force of a second coil spring 15. Also in the knocked state of FIG. 7 in which the knock body 6 is pushed to the front side, the spring force of the first coil spring 34 is smaller than the spring force of the second coil spring 15.

Next, a state in which a knock body 6 is pushed to the front side (knocking operation) so that a ballpoint chip 13 which is a writing distal end of a ballpoint refill 8 is projected and retracted from a front end opening 3*a* of a front shaft 3 is described.

Figure 7:
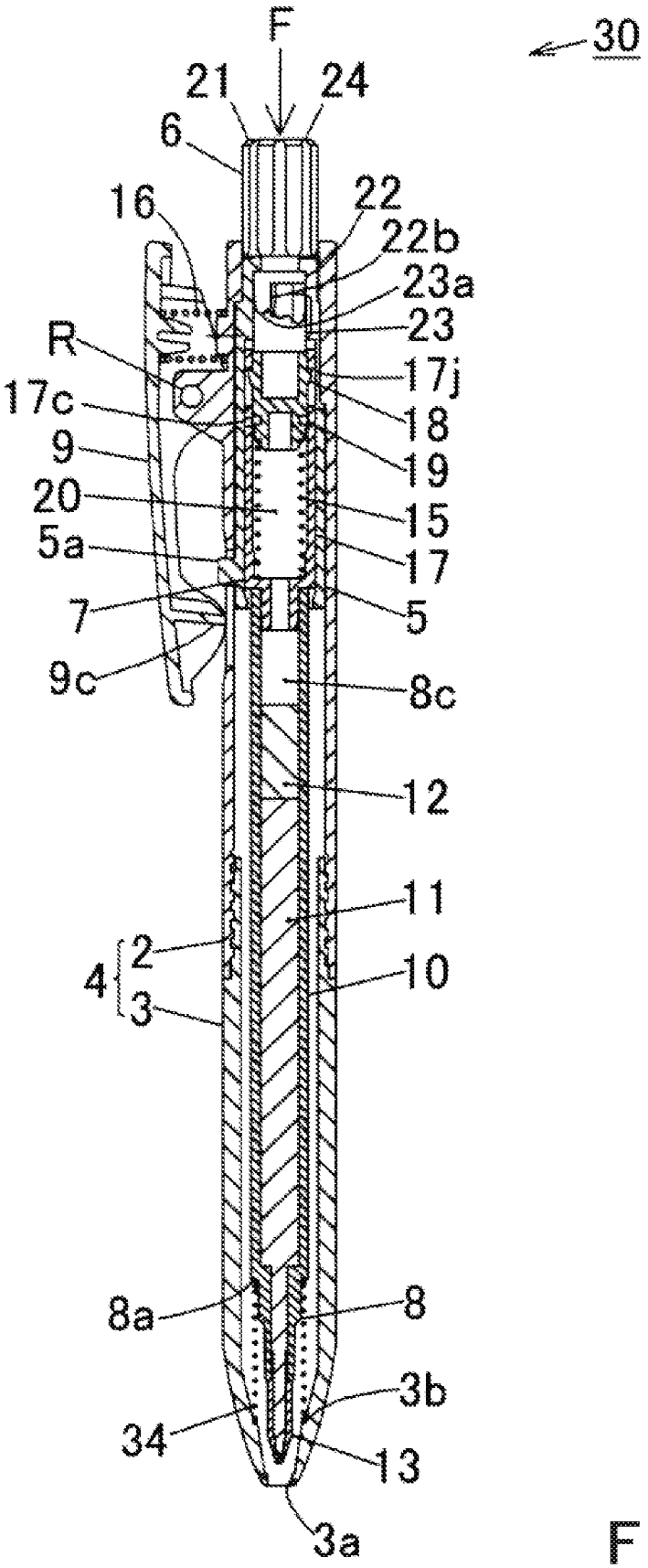
FIG. 7 is a longitudinal sectional view showing a modification example of a pressurizing writing implement.
Figure 8:
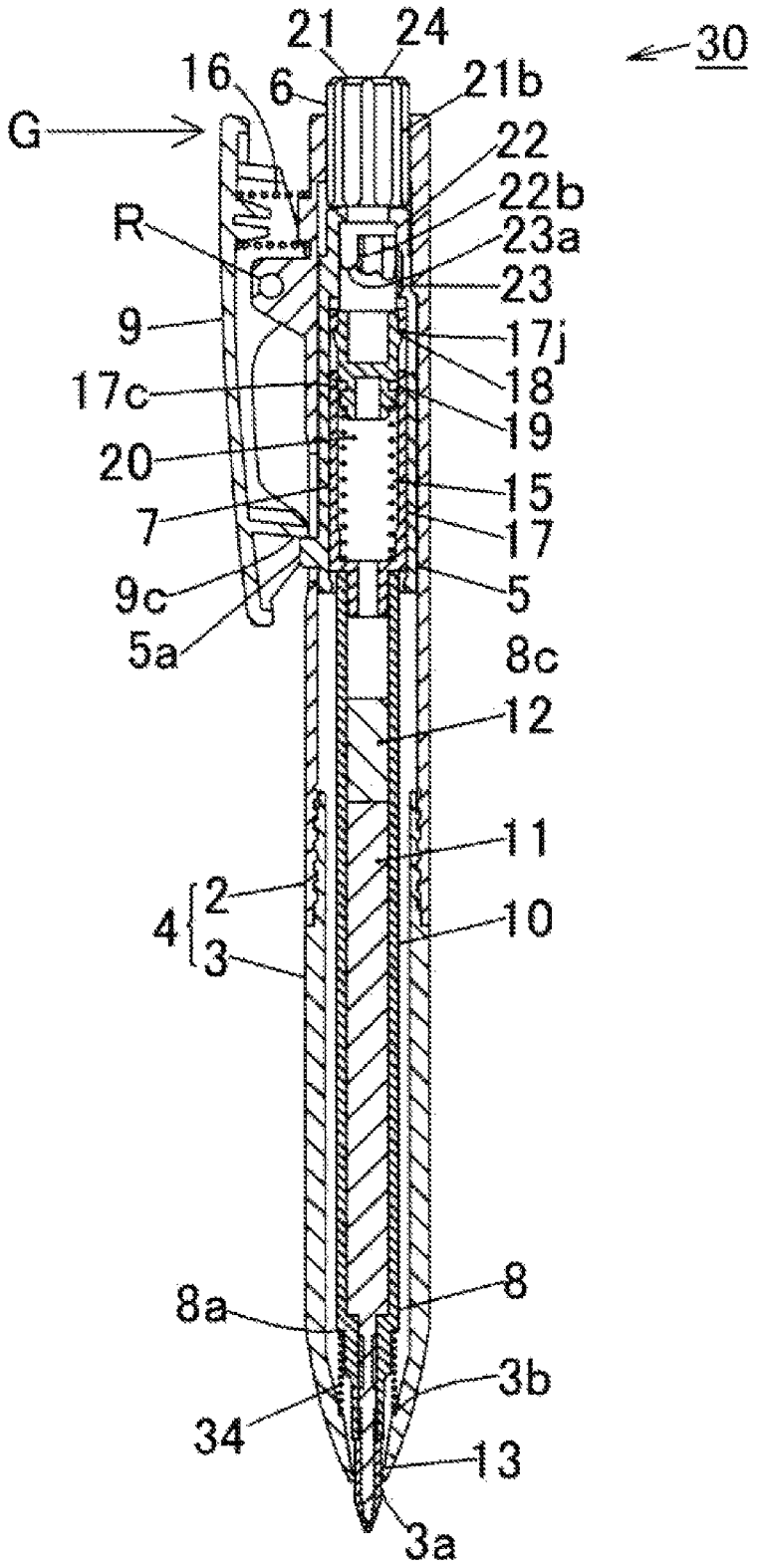
FIG. 8 is a longitudinal sectional view showing a state in which a knock body is pushed.

When the knock body 6 is pushed to the front side (direction shown by arrow F in FIG. 7) from the state of FIG. 7, a piston 18 pressed by the knock body 6 through a cam member 23 moves to the front side. At this time, since the spring force of the second coil sparing 15 is invariably larger than the spring force of the first coil spring 34, the cylinder 17 and the ballpoint refill 8 are pushed to the front side to move to the front side, without the second coil spring 15 being compressed so that the pressurizing force 20 remains to be not pressurized, and a front end of the ballpoint tip 13 projects from the front end opening 3*a* of the front shaft. At this time, since an engagement projection 5*a* of a slide member 5 is engaged with an engaged part 9*c* of a distal end of a clip 9 disposed on a side surface of a back shaft 2, so that the front end of the ballpoint tip 13 is maintained to project from the front end opening 3*a* of the front shaft (shaft tube 4), which is shown in FIG. 8.

Since a protrusion 18*b* of a piston 18 is in contact with a window back end 17*j* of a cylinder 17, the forward movement of the cylinder 17 and the ballpoint refill 8 is restricted and stopped Then when a back end part of the clip 9 is pushed (in a direction shown by the arrow G in FIG. 8) so as to disengage the engagement state between the engagement projection 5*a* of the slide member 5 and the engaged part 9*c* of the clip 9, the ballpoint refill 8, the cylinder 17, the piston 18 and the knock 6 are moved to the back side by the spring force of the first coil spring 34 so as to return to the state shown in FIG. 7.

Next, in this modification example, a state in which a pressure is applied by a writing pressure upon writing to a back end of the ink 11 in the ballpoint refill 8 through an ink follower 12.

Figure 9:
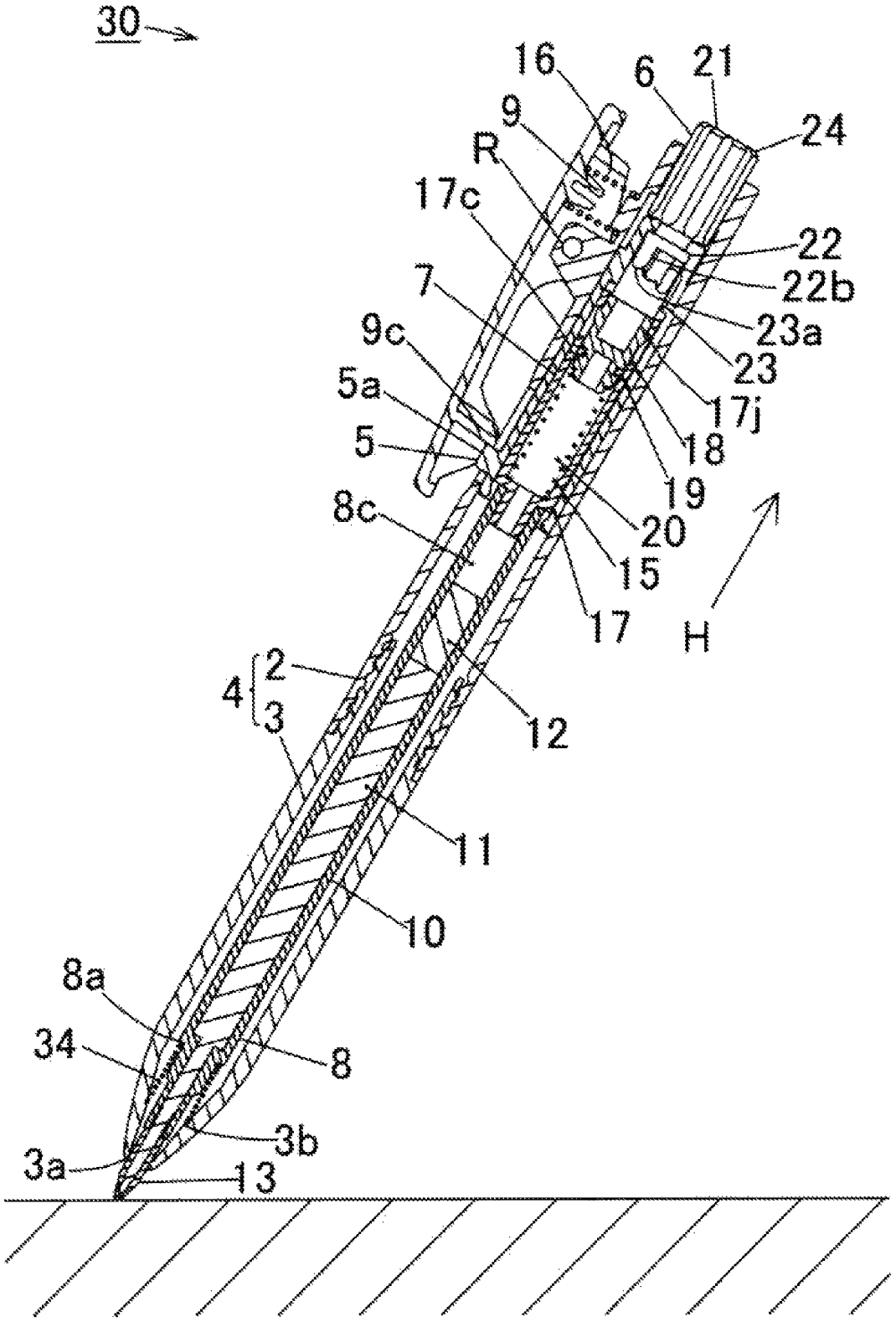
FIG. 9 is an explanatory view showing a state in which the pressurized-type writing implement is used.
Figure 10:
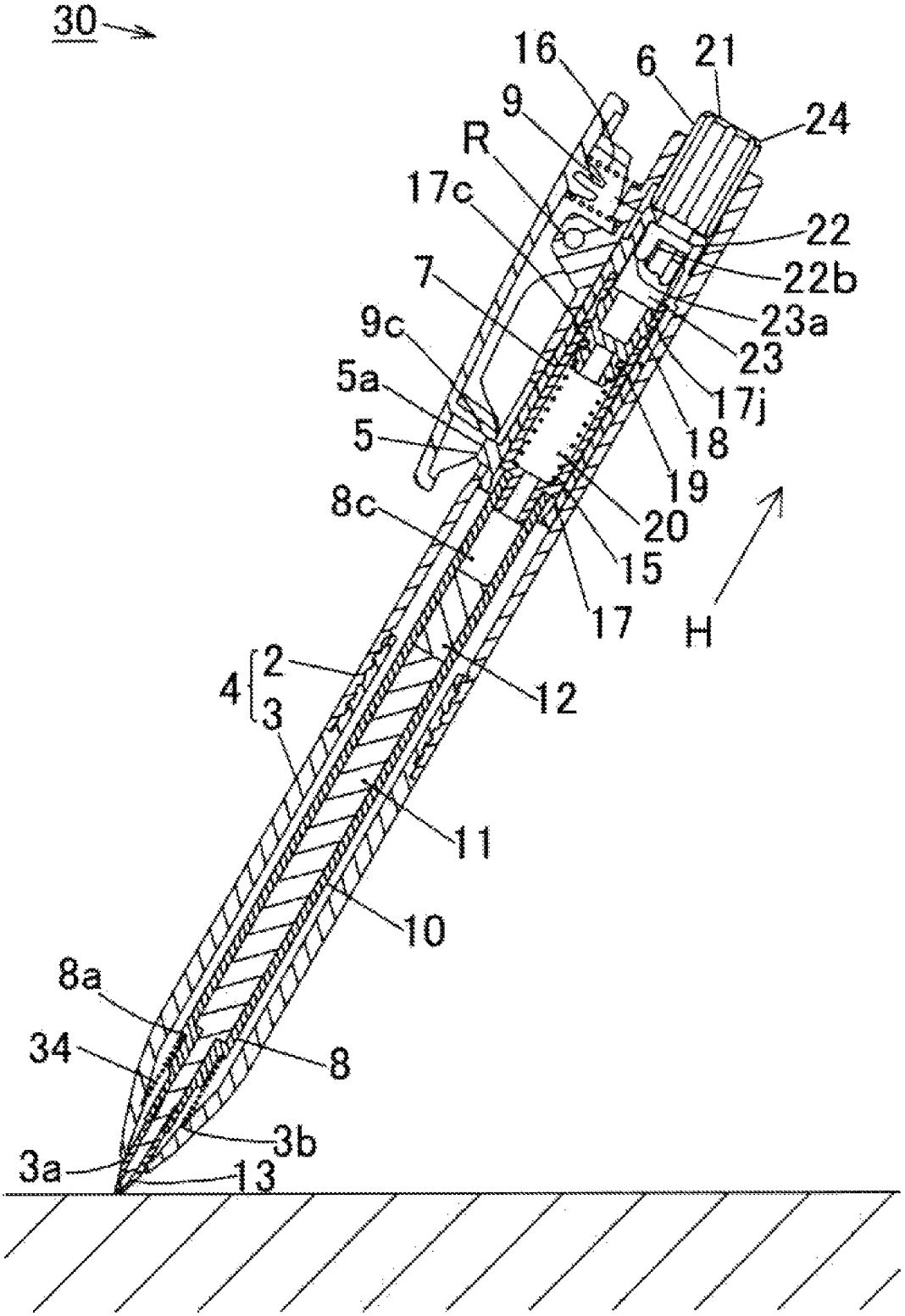
FIG. 10 is an explanatory view showing a state in which a writing pressure is applied along a shaft center from the state of FIG. 9.

As shown in FIG. 9, when writing is performed to apply a writing pressure with the front end of the ballpoint tip 13 projecting from the front end opening 3*a* of the front shat 3, the ballpoint refill 8 and the cylinder 17 are moved in accordance therewith to the back (a direction shown by the arrow H) against the spring force of the second coil spring 15, because the piston 18 in contact with the cam member 23 cannot be moved to the back side. To be specific, the second coil spring 15 firstly compresses so that the cylinder 17 moves to the back side. Then, the air hole 17*c* of the cylinder 17 moves to the back side from the position of the O-ring 19, so that the pressurized space 20 is sealed by the O-ring 19. When the cylinder 17 further moves to the back side, the second coil spring 15 is further compressed so as to compress the back inner hole 8*c* of the ballpoint refill 8 and the pressurized space 20. Thus, the pressure is applied to the back end of the ink 11 in the ballpoint refill 8 through the ink follower 12, which is shown in FIG. 10. In this case, as shown in FIG. 10, the pressurized-type writing implement 30 is adjusted such that a volume of the pressurized space (pressurized chamber) 20 is decreased during writing by the rotation of the knock body 6.

In addition, when the writing pressure is released, the cylinder 17 and the ballpoint refill 8 move to the front side (original position) by the spring force of the second coil spring 15. At this time, when the position of the air hole 17*c* of the cylinder 17 reaches the O-ring 19, the air hole 17*c* is opened. Thus, the sealing of the pressurized space 20 and the back inner hole 8*c* of the ballpoint refill 8 is released so as to have the same pressure as an atmospheric pressure to return to the state shown in FIG. 9.

Also in this modification example, similarly to the aforementioned first embodiment, by rotating the knock body 6 with respect to the back shaft 2, a pressure applied to the ink 11 can be adjusted.

In addition, in this modification example, in the knocked state in which the knock body 6 is pushed to the front side, the pressurizing mechanism 7 is not actuated so that the ink 11 is not pressurized. Thus, when stored with the knocked state, leakage of the ink 11 from the front end of the ballpoint tip 13 can be prevented.

The pressurized-type writing implement 30 in this modification example is configured such that the spring force of the first spring body 34 is smaller than the spring force of the second spring body 15, in the knocked state in which the knock body 6 is pushed to the front side so that the ball point refill 8 is projected from the front end opening 3*a* of the shaft tube 4.

According to such a pressurized-type writing implement 30, since the cylinder 17 and the refill 8 pushed by the second spring body (second coil spring) 15 to the front side move to the front side against the spring force of the first spring body (first coil spring) 34, there is no possibility that the pressurized chamber (pressurized space) 20 also in the cylinder 17 is pressurized in the knocked state. Thus, the pressurized-type writing implement 30 can be used as a writing pressure type, in which when starting writing to apply a writing pressure to the distal end of the ballpoint refill 8, the ballpoint refill 8 pressed by the writing pressure is moved to the back side against the spring force of the second spring body 15 so that the cylinder 17 is simultaneously moved to the back side, whereby the pressurized chamber 20 in the cylinder 17 is pressurized so that a pressure is applied to the back end of the writing implement ink composition 11.

In the writing pressure type, a pressure is applied to the back end of the writing implement ink composition 11 only when a writing pressure is applied. Thus, even when the writing implement is stored or left with the knock body 6 being pushed to the front side (knocking operation), there is no possibility that a pressure is applied to the writing implement ink composition 11. Thus, leakage of ink from the front end of the ballpoint refill 8 can be prevented.

In the present invention, the first spring body 34 is preferably exchangeable. By converting a spring strength relationship between the first spring body 34 and the second spring body 15, the writing implement can be easily switched between the knock pressure type and the writing pressure type. Namely, in the pressurized-type writing implement 1 of the present invention, by replacing the first coil spring (first spring body (34) so as to invert a spring strength relationship between the first coil spring (first spring body) 34 and the second coil spring (second spring body 15) in the knocked state, a type in which the ink 11 is pressurized by the knocking operation (knock pressure type) and a type in which the ink is pressurized by applying a writing pressure (writing pressure type) can be switched.

Second Embodiment

As shown in FIGS. 11 to 15, in a pressurized-type writing implement 101 in this embodiment, a shaft tube 104 is formed by threadedly engaging a front shaft 103 with a front side of a back shaft 102. The pressurized-type writing implement 101 is composed of a slide member 105 disposed in the shaft tube 104 so as to be movable in the back and forth direction, a knock body 106 locked to a back part of the slide member 105, a pressurizing mechanism 107 disposed in the slide member 105, a refill (ballpoint refill) 108 mounted on a front part of the pressurizing mechanism 107 so as to be slidable in the back and forth direction in the shaft tube 104, and a clip 109 rotatably locked on a side surface of the back shaft 102.

The ballpoint refill 108 is obtained by directly housing, in a transparent ink storage tube 110 made of a PP resin, the ink 111 which is an ink composition for writing implement and a grease-like ink follower 112 at a back end of the ink 111, the ink follower 112 following the ink 11 as it is consumed, and by press-fitting a back end of part of a ballpoint tip 13 rotatably holding a ball (ϕ 0.38 mm) into a front end opening of the ink storage tube 10.

Figure 11:
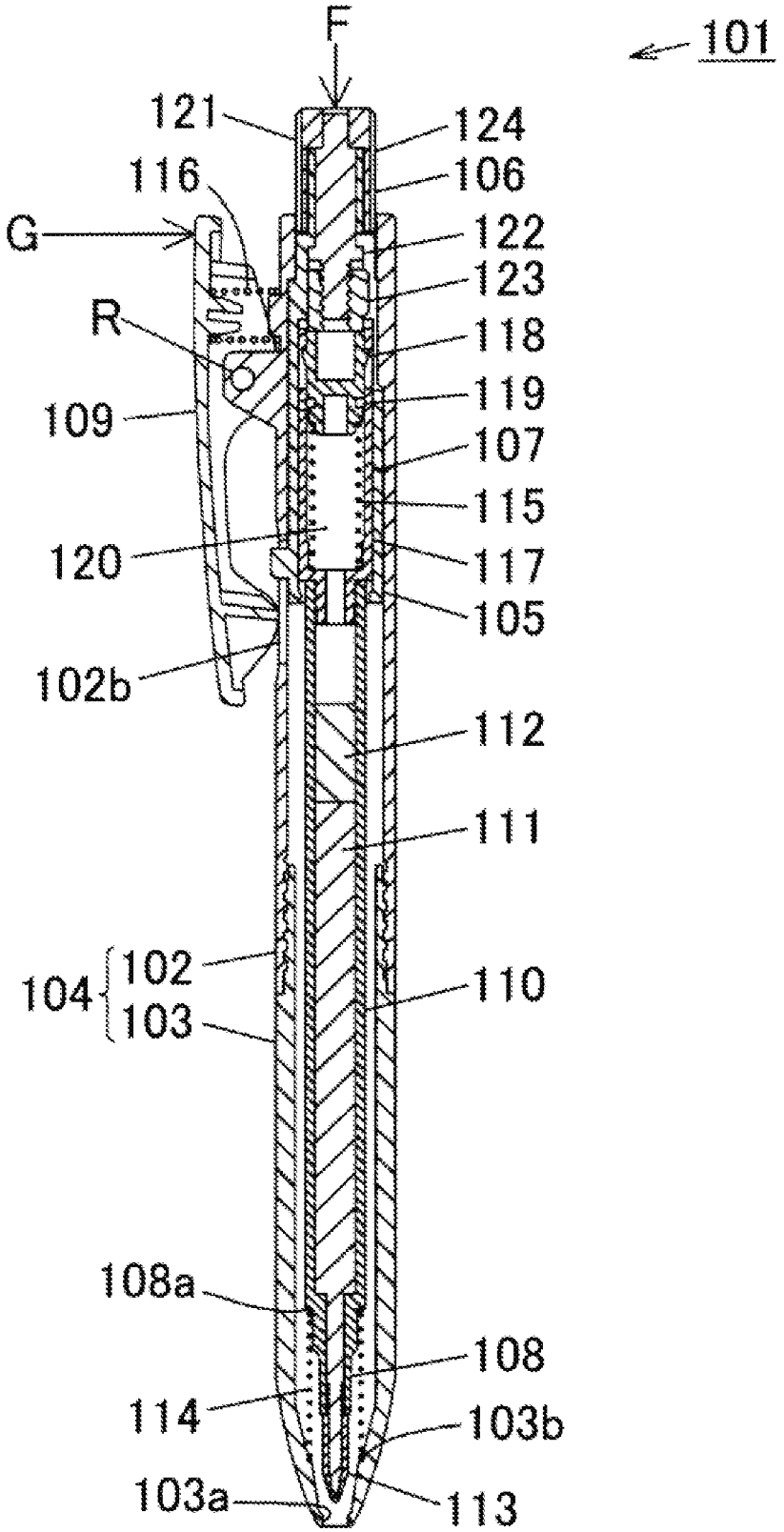
FIG. 11 is a longitudinal sectional view of a pressurized-type writing implement in a second embodiment.

As shown in FIG. 11, the front shaft 103 (shaft tube 104), has, at this front end, the front end opening 103*a* form which a ballpoint tip 113 of the ballpoint refill 108 can project. In addition, a first coil spring 114 (first spring body) 114 in a compressed state is extended between an inner step part 103*b* formed on an inner surface of the front shaft 103 (shaft tube 104) and an outer step part 108*a* formed on an outer circumferential surface of the ballpoint refill 108 so as to elastically urge the ballpoint refill 108 to the back side with respect to the shaft tube 4.

Figure 12:
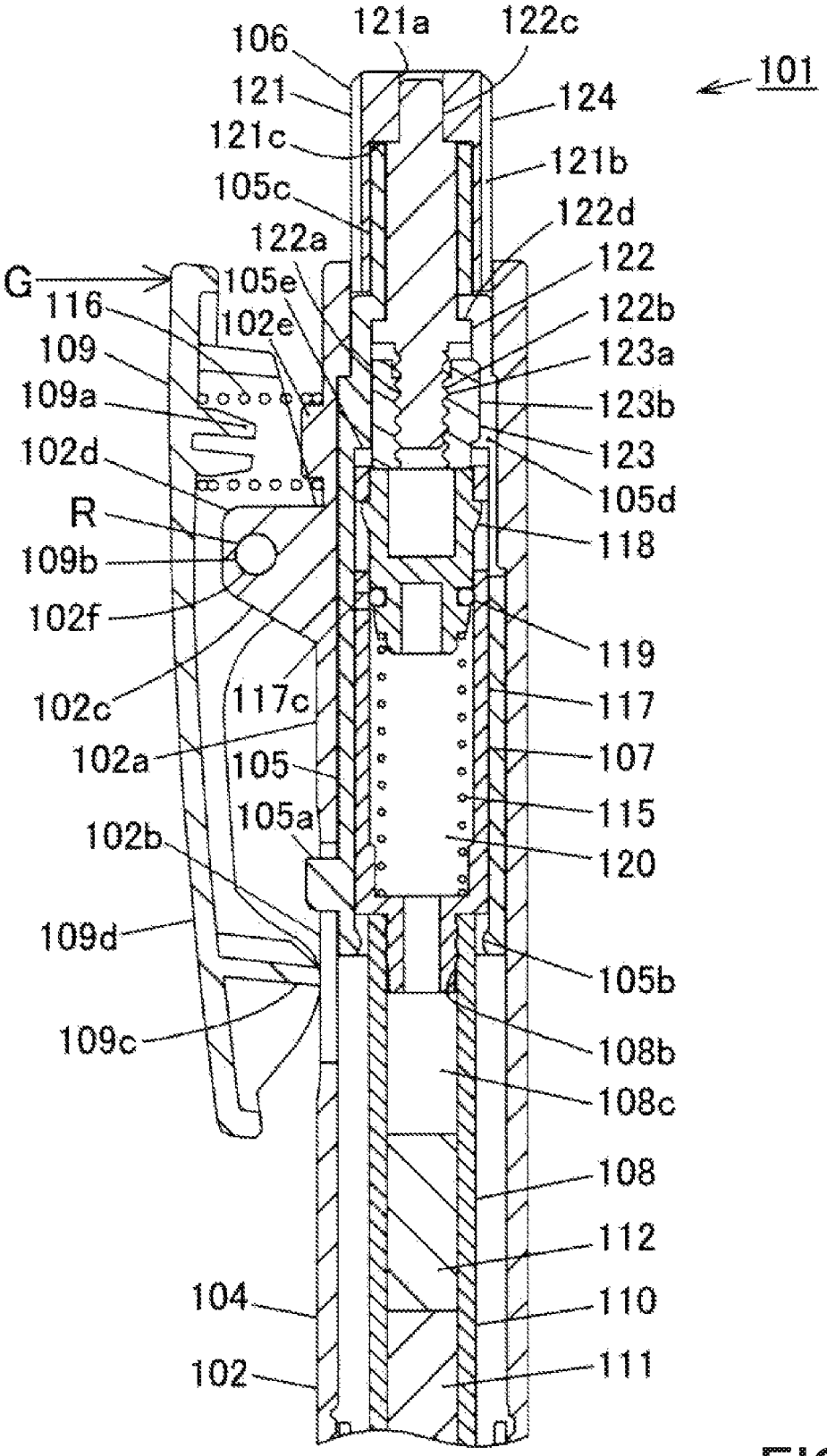
FIG. 12 is an enlarged longitudinal sectional view in which a main part of FIG. 11 is enlarged.

The back shaft 102 (shaft tube 104) is formed to have a cylindrical shape. As shown in FIG. 12, an outside surface 102*a* has a side hole 2*b* which extends along an axial direction to pass through an inner hole. In addition, the outside surface 102*a* has a clip locking part 102*c* which projects outward. The clip locking part 102*c* is composed of a clip locking projection 102*d* and a spring locking projection 102*e*. The clip locking projection 2*d* has a locking hole 102*f* in a direction orthogonal to the axial direction.

Figure 13:
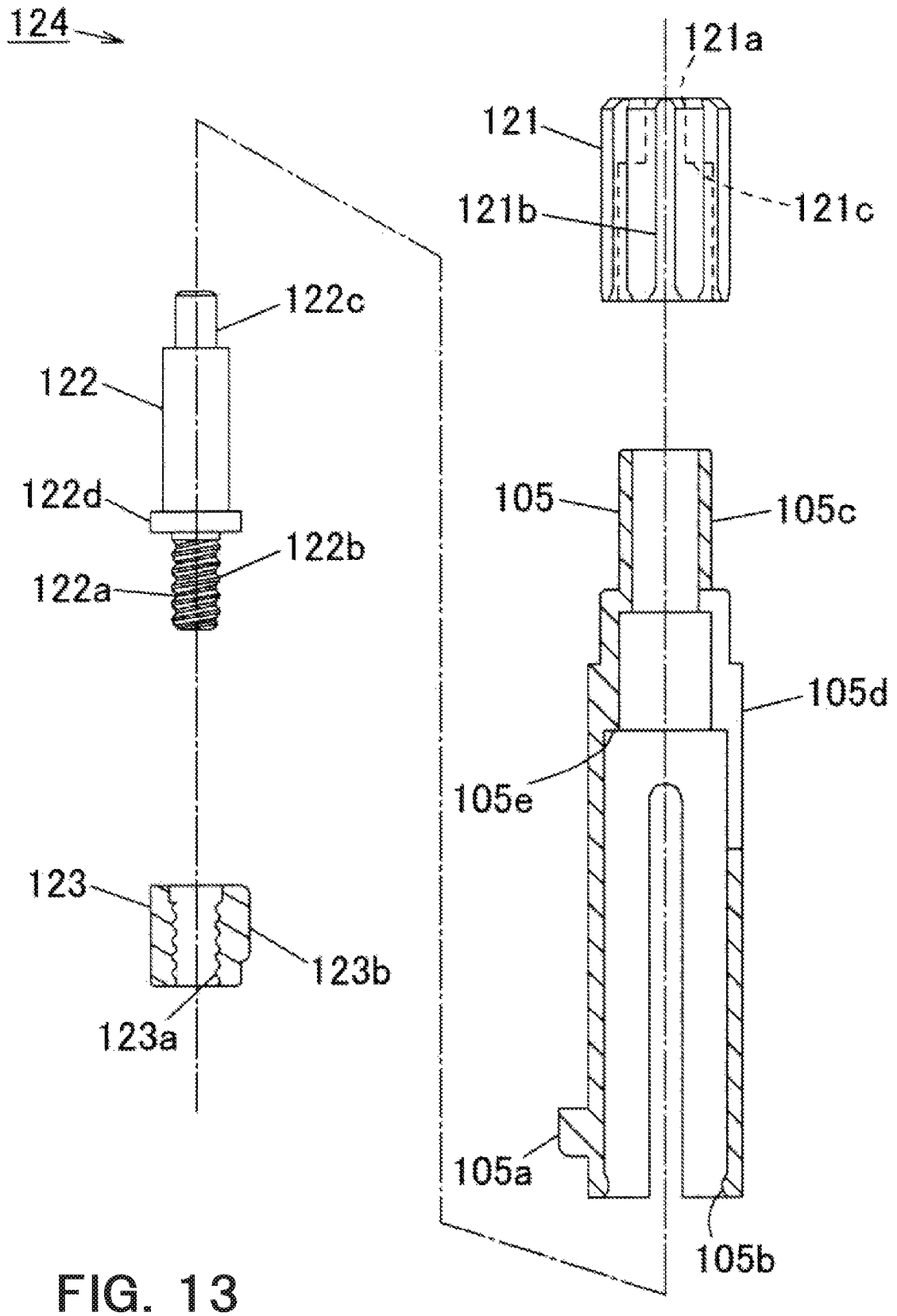
FIG. 13 is an exploded view for describing a structure of a projecting and retracting mechanism.

As shown in FIGS. 11 to 13, the slide member 105 has on its outer circumferential part an engagement part 105*a* that projects outward. By positioning the engagement part 105*a* in the side hole 102*b* of the back shaft 102, the slide member 105 is mounted on the back 102 so as to be slidable in the back and forth direction and unrotatable.

In addition, a front inner hole of the slide member 105 has a plurality of projecting stoppers 105*b* that project inward, and a back step part 105*c* having a smaller internal diameter is formed on a back end of the slide member 105.

Further, the slide member 105 has on its back outside surface a slidable-member side hole 105*d* that extends along the axial direction.

As shown in FIGS. 11 and 12, the clip 109 has a clip spring 116 disposed between the spring locking projection 102*e* of the back shaft 102 and an inner projection 109*a* formed on an inner wall part of the clip 109 so as to project toward the shaft tube 104. A locking shaft part 109*b* formed on an inside wall of the clip 109 is locked in the locking hole 102*f*, so that a distal end part of the clip 109 is elastically urged invariably onto an outer wall surface of the back shaft 102. In addition, the clip 109 is configured as a movable clip such that, by pushing a back end part of the clip 9 (in a direction a direction shown by the arrow G in FIG. 12), the distal end part of the clip 109 can be moved away from the outer wall surface of the back shaft 102 with a locking axis R between the clip 109 and the back shaft 102 serving as a fulcrum point.

The clip 109 has on this front part an engaged part 109*c* extending from a proximal part 109*d* toward the shaft tub 104 so as to be engaged with the engagement projection 105*a* formed on the side surface of the slide member 105.

Figure 14:
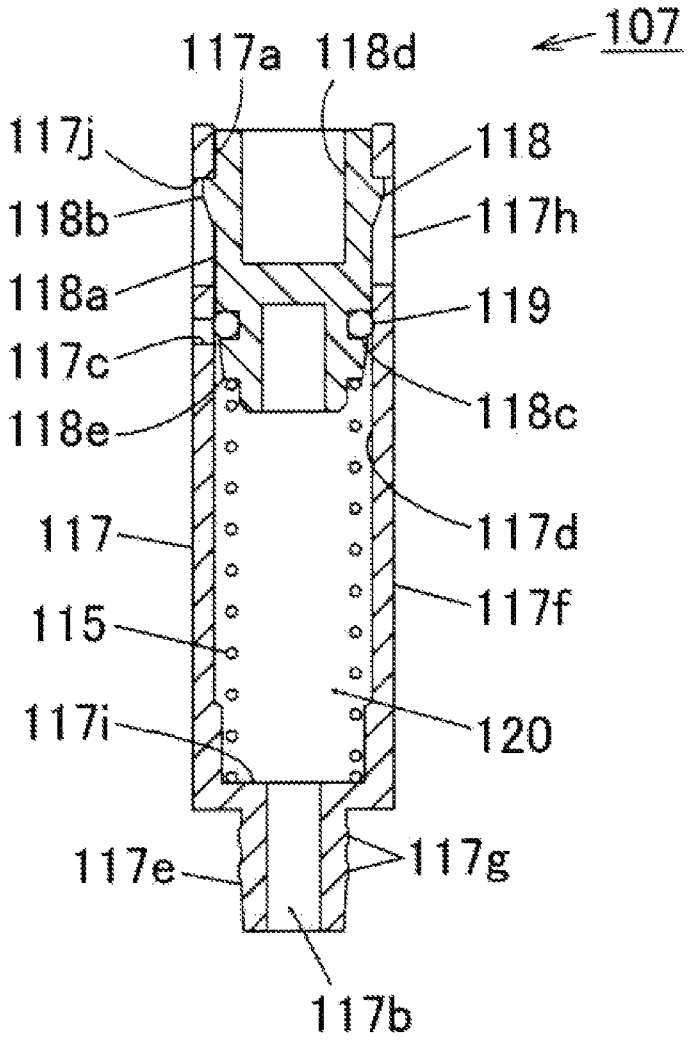
FIG. 14 is a longitudinal sectional view of a pressurizing mechanism of FIG. 11.

As shown in FIGS. 11, 12 and 14, the pressurizing mechanism 107 is housed on the back side of the ballpoint refill 108 and inward the slide member 105 so as to be slidable in the back and forth direction with respect to the slide member 105. The pressurizing mechanism 107 is composed of a cylindrical cylinder 117, a piston inserted in a back end opening 117*a* of the cylinder 117 and disposed so as to be slidable in the back and forth direction with resect to the cylinder 117, an O-ring 119 fitted on a side surface of the piston 118, and a second coil spring 115 (second spring body) 115 extended between the cylinder 117 and the piston 118.

A forward movement of the pressurizing mechanism 117 is restricted by the stoppers 105*b* of the slide member 105.

The cylinder 117 is described in detail. As shown in FIG. 14, the cylinder 117 has a stepped inner hole 117*b* passing therethrough in the back and forth direction. An air hole 117*c* passing through to the inner hole 17*b* is formed in an outer circumferential surface of the cylinder 117.

In addition, in the inner hole 117*b*, a pressurized space 120 (pressurized chamber) 120, which is surrounded by an inside part 117*d* of the cylinder 117, a front end of the piston 118, and the O-ring 119, is formed. The pressurized space 120 is in ventilatory communication with the outside of the cylinder 117 through the air hole 117*c*.

Further, a front part 117*e* of the cylinder 117 has a diameter smaller than that of central part 117*f*. The front part 117*e* has two fixing parts 117*g* along the axial direction. The fixing part 117*g* circumferentially projects outward. In addition, a back end inner circumferential part 108*b* of the ballpoint refill 108 is removably fixed on the fixing parts 117*g* of the cylinder 17. The pressurized space 20 is in communication with a back inner hole 108 of the ball point refill 108 through the inner hole 117*b* of the cylinder 117.

An outward projection amount (external diameter) of the fixing part 117*g* is adjusted such that, when the ballpoint refill 108 is fixed on the cylinder 117, airtightness between the cylinder 117 and the ballpoint refill 108 is ensured, and that the ballpoint refill 108 can be easily removed by hand.

For example, when the ballpoint refill 108 is attached to the cylinder 117, a force applied thereto is 10 N.

The piston 118 is described in detail. The piston 118 has on this outer circumferential part 118*a* two protrusions 118*b* projecting outward, which are arranged symmetrically with respect to a shaft center. The protrusions 118*b* are locked on a window part 117*h* so as to be slidable in the back and forth direction. The window part 117*h* is formed on the central part 117*f* of the cylinder 117 so as to extend along the shaft center.

The outer circumferential part 118*a* of the piston 118 has a recessed concave part 118*c* extending in an axially circumferential direction. An O-ring (sealing member) 119 made of a synthetic rubber is fitted in the concave part 118*c*. An outside part of the O-ring 119 is in slidable contact with the inside part 117*d* of the cylinder 117. The back end opening 117*a* of the cylinder 117 is air-tightly sealed by the piston 118 and the O-ring 119. In addition, a back end surface of the piston 118 has a back inner hole 118*d* formed to be recessed to the front side.

When the cylinder 117 is moved to the back side, the back end of the cylinder 117 comes into contact with the inner step part 105*e* of the slide member 5, so that the backward movement of the cylinder 117 is restricted.

The second coil spring 115 (second coil spring) 115 is described in detail. The second coil spring 115 is extended between an inner step part 117*i* of the cylinder 17 and a front step part 118*e* of the piston 118 so as to elastically urge the cylinder 117 to the front side with respect to the piston 118.

When the cylinder 117 is slid in the back and forth direction so that the O-ring 19 is positioned on the front side of the air hole 117*c* of the cylinder 117, the pressurized space 20 is hermetically sealed. When the O-ring 119 is positioned on the back side of the air hole 117*c*, the pressurized space 120 and the outside of the cylinder 117 are in ventilatory communication with each other through the air hole 117*c*, and is not hermetically sealed.

Next, the knock body 106 is described in detail. As shown in FIGS. 11 to 13, the knock body 106 is composed of a cylindrical knob 121 and a rod-like front member 122.

The front member 122 has on its outside surface an external screw part 122*b*. By inserting a back part 122*c* into a back inner hole 121*a* of the knob 121, the front part 122 and the knob 121 are irremovably press-fitted.

The knob 121 has on its outside surface a plurality of groove parts 121*b* which extend in the shaft center direction at equal intervals therebetween. Due to the groove parts 121*b*, the knock body 106 is not slippery when grasped by hand.

When the front member 122 and the knob 121 are press-fitted, the back step part 105*c* having a smaller diameter, which is formed on the back part of the slide member 105 is disposed between a flange part 122*d* formed on the side surface of the front member 122 and the inner step part 121*c* of the knob 121. Thus, the knock body 106 is locked so as to be rotatable with respect to the slide member 105. Thus, the knock body 160 together with the slide member 105 is configured to be slidable in the back and forth direction with respect to the shaft tube 104.

In addition, a slidable member 123 is disposed between the flange part 122*d* of the front member 122 and the back end of the piston 118. The slidable member 123 has on its inner surface an internal screw part 123*a* that is threadedly engaged with the external screw part 122*b* of the front member 122.

Further, the slidable member 123 has on its outer circumferential surface a slidable projection 123*b* which projects outward and extends in the back and forth direction. By inserting the slidable projection 123*b* into the slidable-member side hole 105*d* of the slide member 105 so as to be movable in the back and forth direction, the slidable member 123 is fixed so as to be movable in the back and forth direction and unrotatable with respect to the slide member 105.

The slide member 105, the knock body 106 and the slidable member 123 constitute a projecting and retracting mechanism 124 that projects and retracts the front end of the ballpoint refill 108 with respect to the front end opening 103*a* of the front shaft 103 by the knocking operation that pushes the knock body 106 to the front side. By rotating the knock body 106 of the projecting and retracting mechanism 124, the slidable member 123 is moved in the back and forth direction, so that a pressure of the pressurized space 120 can be adjusted.

A relationship between spring forces of the first coil spring 114 and the second coil spring 115 is described.

Figure 15:
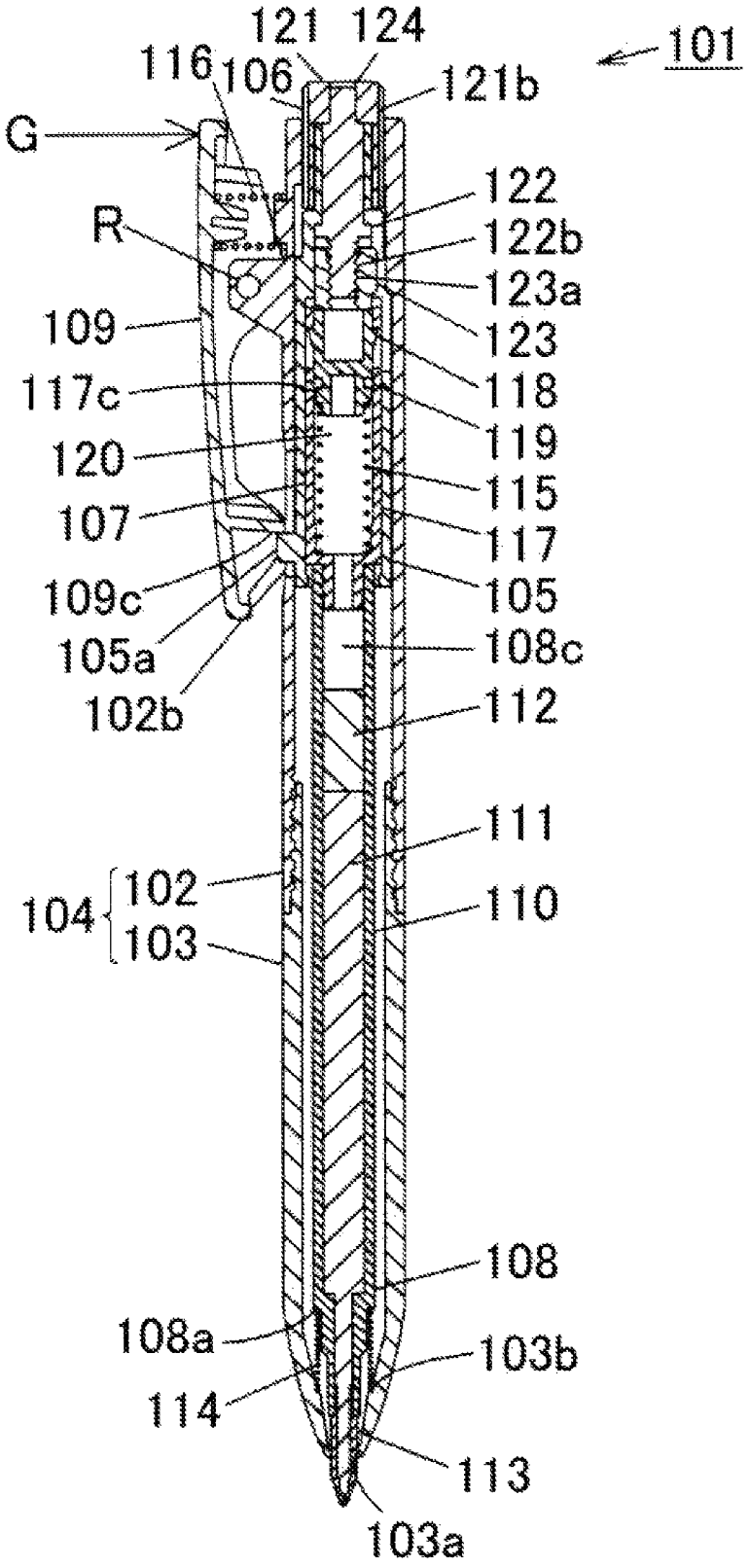
FIG. 15 is a longitudinal sectional view showing a knocked state in which a knocking element is pushed from the state of FIG. 11.

The spring forces of the respective coil spring are adjusted such that, in the attached state (not-knocked state) of FIG. 11, the spring force of the first coil spring 114 is smaller than the spring force of the second coil spring 115, and that, also in a state of FIG. 15 (knocked state) in which the knock body 106 is pushed to the front side, the spring force of the first coil spring 114 is smaller than the spring force of the second coil spring 115.

Next, there is described a state in which, by pushing the knock body 106 to the front side, the ballpoint tip 113 as a writing distal end of the ballpoint refill 108 projects or retracts from the front end opening 103*a* of the front shaft 103.

When the knock body 106 is pushed to the front side (in a direction shown by the arrow F in FIG. 11) from the state of FIG. 11, the piston 118 pressed by the knock body 106 through the slidable member 123 moves to the front side. At this time, since the spring force of the second coil spring 115 is set to be invariably larger than the spring force of the first coil spring 114, the cylinder 117 and the ballpoint refill 108 are pushed to the front side so as to move to the front side with the second coil spring 115 not being compressed and with the pressurized space 120 not being pressurized, so that the front end of the ballpoint tip 113 projects from the front end opening 103*a* of the front shaft 103. Then, the engagement part 105*a* of the slide member 105 is engaged with the engaged part 109*c* of the distal end part of the clip 109 disposed on the side surface of the back shaft 102. Thus, the front end of the ballpoint tip 113 is maintained to project from the front end opening 103*a* of the front shaft 103 (shaft tube 104), which is shown in FIG. 15.

When the protrusion 118*b* of the piston 118 comes into contact with a window back end 117*j* of the cylinder 117, the forward movement of the cylinder 117 and the ballpoint refill 108 is restricted to be stopped.

When the back end part of the clip 109 is pushed (in a direction shown by the arrow G in FIG. 15) so as to disengage the engagement between the engagement part 105*a* of the slide member 105 and the engaged part 109*c* of the clip 109, the ballpoint refill 108, the cylinder 117, the piston 118 and the knock body 106 are moved to the back side so as to return to the state shown in FIG. 11.

Next, there is described a state in which a pressure is applied by a writing pressure upon writing to the back end of the ink 111 in the ballpoint refill 108 through the ink follower 112.

Figure 16:
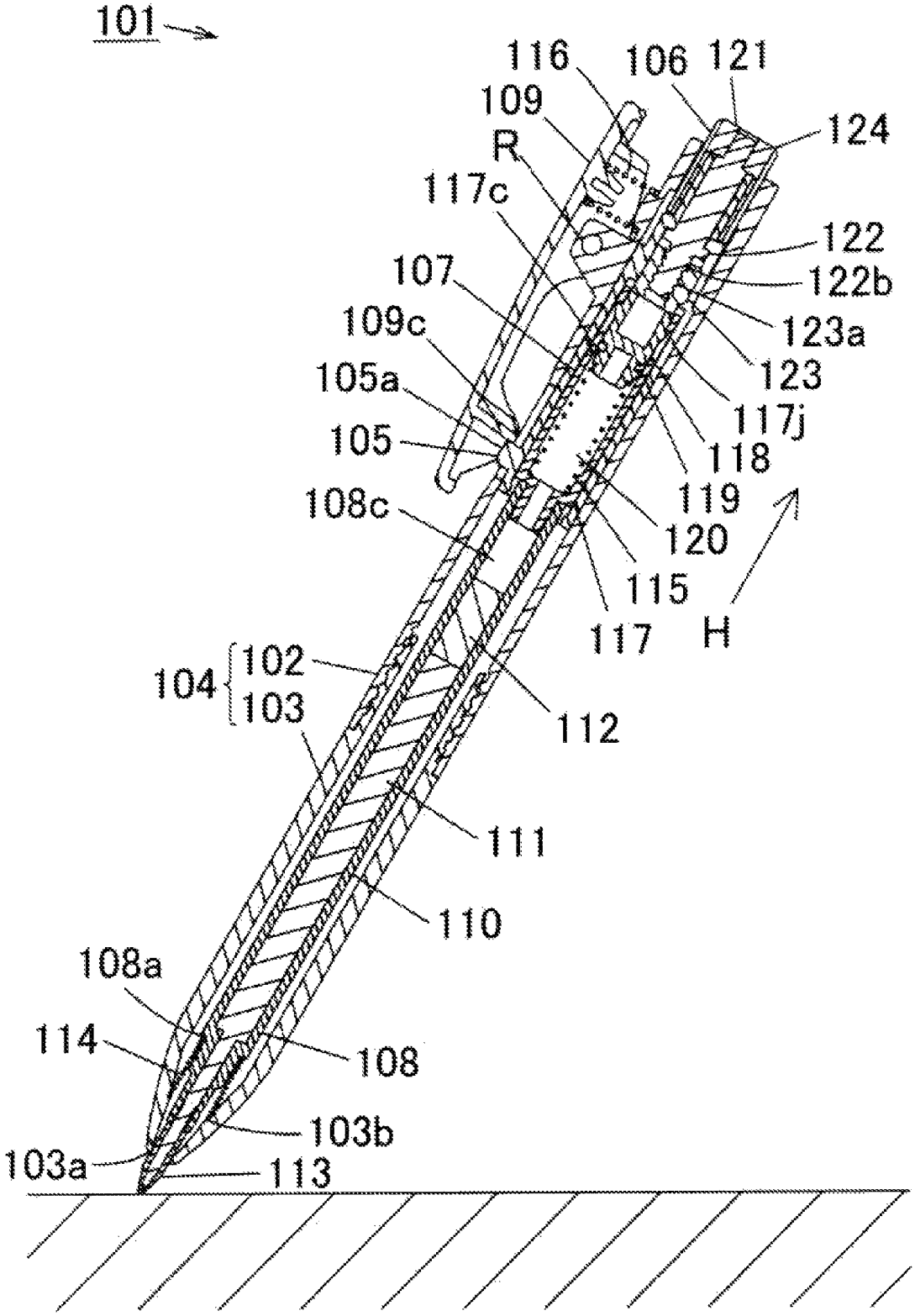
FIG. 16 is an explanatory view showing a state in which the pressurized-type writing implement of FIG. 15 is used.
Figure 17:
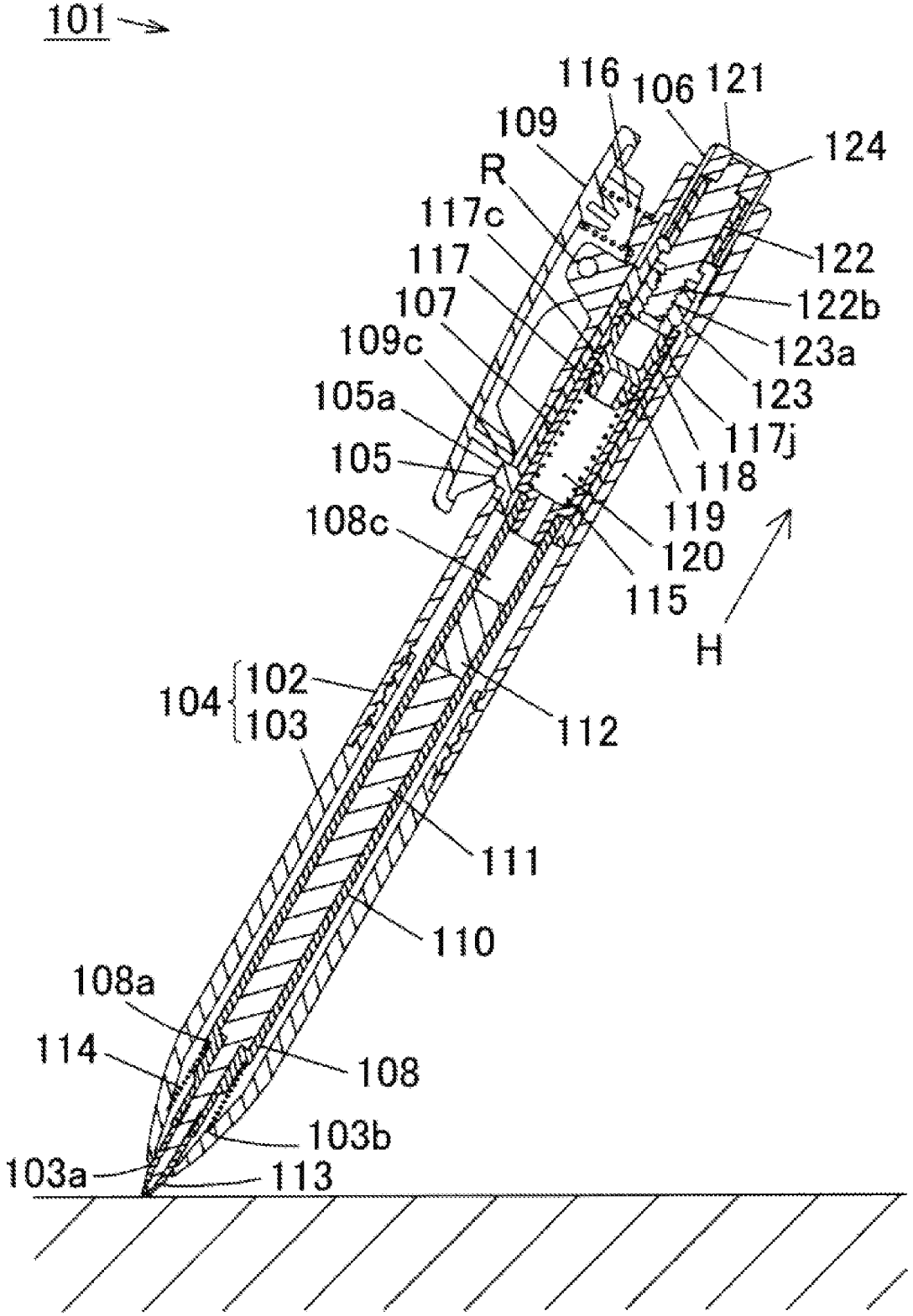
FIG. 17 is an explanatory view showing a state in which a writing pressure is applied along a shaft center from the state of FIG. 16.

As shown in FIG. 16, when the shaft tube 104 is held in an inclined manner and a writing pressure is applied to the front end of the ballpoint refill 108 with the front end of the ballpoint tip 113 projecting from the front end opening 103*a* of the front shaft 103 as shown in FIG. 15, since the piston 118 in contact with the slidable member 123 cannot be moved to the back side, the ballpoint refill 108 and the cylinder 117 are moved in accordance therewith to the back side (a direction shown by the arrow H) against the spring force of the second coil spring 115. To be specific, when the second coil spring 115 is firstly compressed so that the cylinder 117 is moved to the back side, the air hole 117*c* of the cylinder 117 is moved to the back side of the position of the O-ring 119 so that the pressurized space 120 is hermetically sealed by the O-ring 119. Further, the cylinder 117 is moved to the back side, the second coil spring 115 if further compressed, and the back inner hole 108*c* of the ballpoint refill 108 and the pressurized space 120 are compressed. Thus a pressure is applied to the back end of the ink 111 in the ballpoint refill 108 through the ink follower 112, which is shown in FIG. 17.

When the writing pressure is released, the cylinder 117 and the ballpoint refill 108 are moved to the front side (original position) by the spring force of the second coil spring 115. At this time, when the position of the air hole 117*c* of the cylinder 117 reaches the O-ring 119, the air hole 117*c* is opened. Thus, the hermetical sealing of the pressurized space 20 and the back inner hole 108*c* of the ballpoint refill 108 is released so as to have the same pressure as an atmospheric pressure to return to the state shown in FIG. 16.

Figure 18A:
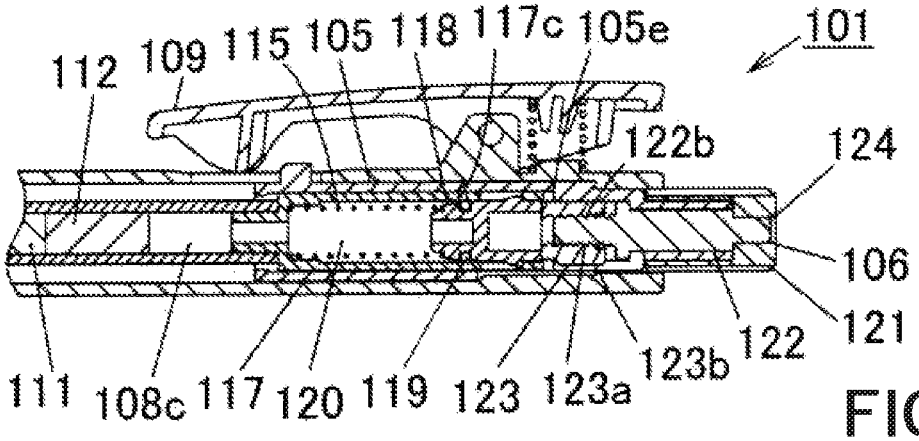
FIG. 18A is an explanatory view showing a state in FIG. 11 in which the knock body is rotated, with a pressurizing force being set at a relatively high pressure.
Figure 18B:
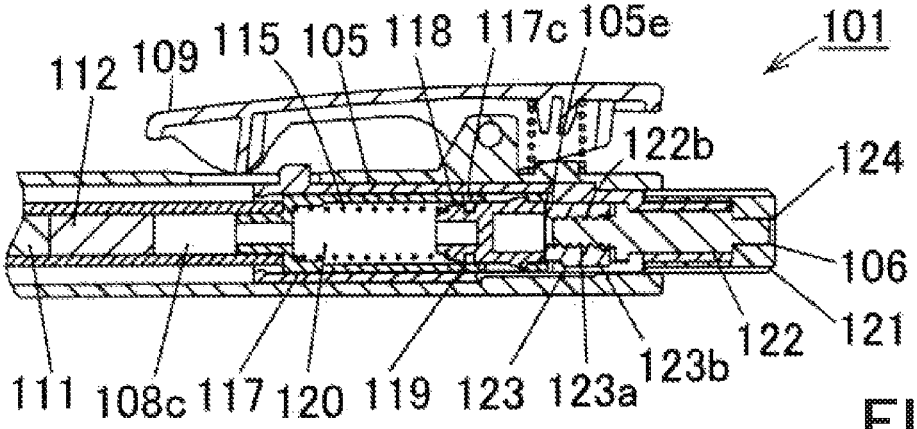
FIG. 18B is an explanatory view showing a state in FIG. 11 in which the knock body is rotated, with a pressurizing force being set at a relatively low pressure.
Figure 18C:
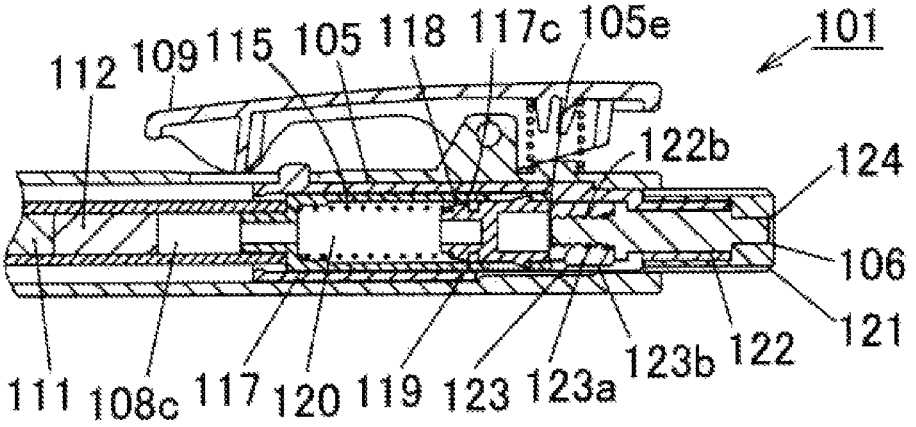
FIG. 18C is an explanatory view showing a state in FIG. 11 in which the knock body is rotated, with no pressurizing force being set to be applied.

Further, in this embodiment, by rotating the knock body 106 with respect to the back shaft 102 in the not-knocked state of FIG. 11, a pressurizing force applied to the ink 111 can be adjusted. When the knock body 106 is rotated to the left from the state of FIG. 18A, since the slidable member 123 screw-fitted in the front member 122 is locked so as to be unrotatable with respect to the slide member 105, the slidable member 123 is gradually moved to the back side with respect to the knock body 106 to the positions of FIGS. 18B and 18C. Thus, when the knock body 106 is pushed to the front side, the protrusion 118*b* of the piston 118 comes into contact with the window back end 117*j* of the cylinder 117, so that a length along which the cylinder 117 moves to the front side reduces, and a gap between the back end of the cylinder 117 and the inner step part 105*e* of the slide member 105 decreases. As a result, when a writing pressure is applied, a length along which the cylinder 117 is moved to the back reduces. Thus, when the knock body 106 is rotated from the state of FIG. 18A to the state of FIG. 18C, a pressure applied to the pressurized space 120 can be gradually lowered. In the state of FIG. 18C, there is no gap between the back end of the cylinder 117 and the inner step part 105*e* of the slide member 105. Since the cylinder 117 cannot be moved to the back side, the pressurized space 120 is adjusted to be not compressed at all. Thus, the pressurized-type writing implement 10 in this embodiment can be used as a general not-pressurized type writing implement.

Due to the above structure, in this embodiment, since the knock body 106 can be pushed with the pressurizing force setting being switched by rotating the knock body 106, the pressurized-type writing implement 101 can be provided, which is capable of easily switching the writing state and the not-writing state by the knocking operation while maintaining the set pressurizing force applied to the back end of the ink 111.

In addition, in this embodiment, the front shaft 103 can be detached from the back shaft 103 by rotating the front shaft 3 with respect tot the back shaft 102. Under this state, when the ballpoint refill 108 is pulled to the front side, the ballpoint refill 108 can be drawn out from the cylinder 117 which cannot be moved to the front side by the stoppers 105*b* of the slide member 105, so that the ballpoint refill 108 an be easily replaced. Further, since it is easy to take out the first spring coil 114 from the front shaft 103, the first coil spring 114 can also be replaced.

At this time, by replacing the first coil spring 114 with a coil spring having a higher spring force such that the spring force of the first coil spring 114 is higher than the spring force of the second coil spring 115 during the knocked state, the pressurized-type writing implement 101 can be changed from the writing pressure type to the knock pressure type.

In the pressurized-type writing implement 101 in this embodiment: the ballpoint refill 108 is housed in the shaft tube 104, wherein the ballpoint refill 108 includes the ink storage tube 110 filled with the writing implement ink composition 111, and the ballpoint tip 113 on the front part of the ink storage tube 110; the pressurizing mechanism 107 that applies a pressure to the back end of the writing implement ink composition 111 is disposed on the back side of the ballpoint refill 108; and the projecting and retracting mechanism 124, which is pushed to the front side to project the front end part of the ballpoint refill 108 from the front end opening 103*a* of the shaft tube 104, is disposed on the back side of the pressurizing mechanism 124; characterized in that: the projecting and retracting mechanism 124 comprises: the slide member 105 disposed so as to be movable in a back and forth direction and unrotatable with respect to the shaft tube 104; the knock body 106 rotatably locked on a back part of the slide member 105, and projecting to the back side from the back end of the shaft tube 104; and the slidable member 123 disposed inside the slide member 105 and locked so as to be movable in the back and forth direction and unrotatable with respect to the slide member 105; the slidable member 123*r* is locked on the knock body 106 so as to be moved in the back and forth direction in accordance with the rotation of the knock body 106, with a front end thereof being in contact with a back end of the pressurizing mechanism 107; the first spring body 114 is disposed between the outer step part 108*a* of the ballpoint refill 108 and the inner step part 103*b* of the shaft tube 104 so that the ballpoint refill 108 is elastically urged to the back side with respect to the shaft tube 104; by pushing the knock body 106 of the projecting and retracting mechanism 124 to the front side, the engagement part 105*a* formed on the outer wall of the slide member 105 is locked on the engaged part 109*c* on the front part of the clip 109 provided on the back part of the shaft tube 104 so that the front end of the ballpoint refill 108 is maintained to project from the front end opening 103*a* of the shaft tube 104, and by pushing the back end part of the clip 109 so as to disengage the engagement state between the engagement part 105*a* and the engaged part 109*c* of the clip 109, the slide member 105 is moved to the back side by the spring force of the first spring body 114 so that the front end of the ballpoint refill 108 is retracted into the front end opening 103*a* of the shaft tube 104; and while the front end of the ballpoint refill 108 is maintained to project from the front end opening 103*a* of the shaft tube 104, the pressurized mechanism 107 is actuated by the ballpoint refill 108 which is moved to the back side by a writing pressure upon writing so as to apply a pressure to the back end of the writing implement ink composition 111, and the pressure applied to the writing implement ink 111 is configured to be adjustable by rotating the knock body 106 of the projecting and retracting mechanism 124 so as to move the slidable member 123 in the back and forth direction.

According to such a pressurized-type writing implement 101, the writing state and the not-writing state can be easily switched by pushing the knock body 106 of the projecting and retracting mechanism 124 to the front side (knocking operation). Further, when the pressurizing-force adjusting mechanism 124 is actuated by rotating the knock body 106 so as to adjust the pressure applied to the back end of the writing implement ink composition 111, a handwriting thickness and a handwriting density can be adjusted in accordance with a user's taste.

In addition, since the pressurized-type writing implement in this embodiment is a so-called writing pressure type, a pressure is applied to the back end of the writing implement ink composition 111 only when a writing pressure is applied. Thus, even when the writing implement is stored or left with the knock body 106 being pushed to the front side (knocking operation), there is no possibility that a pressure is applied to the writing implement ink composition 111. Thus, leakage of ink from the front end of the ballpoint refill 108 can be prevented.

In addition, there is a safety mechanism which disengages the engagement between the engagement part and the engaged part of the clip so that the ballpoint refill 108 is retracted into the front end opening 103*a* of the shaft tube 104, if the front end side of the clip is brought upward when the clip is pegged on a pocket or the like with the engagement part 105*a* formed on the outer wall of the slide member 105 on which the knock body 106 is rotatably locked is engaged with the engaged part 109*c* on the front part of the clip provided on the back end part of the shaft tube 104 so that the ballpoint refill 108 is maintained to project from the front end opening 103*a* of the shaft tube 104. Thus, it can be prevented that the pocket is stained unintentionally.

In addition, it is preferable that the slide member 105 is locked so as to be movable in the back and forth direction and unrotatable with respect to the shaft tube 104, that the knock body 106 is configured to be rotatable and immovable in the back and forth direction with respect to the slide member 105, and that the slidable member 123 is locked so as to be movable in the back and forth direction and unrotatable with respect to the slide member 105. In this case, an operation for projecting and retracting the ballpoint refill 108 by moving the knock body 106 in the back and forth direction (knocking operation), and an operation for adjusting a pressurizing force by rotating the knock body 106 so as to move the slidable member 123 in the back and forth direction, can be performed separately from each other. Thus, the projecting and retracting mechanism 124 in this embodiment can easily switch the writing state and the not-writing state without adjusting a pressurizing force each time.

Further, the locking means for locking the knock body 106 and the slidable member 123 is not specifically limited as long as the slidable member 123 is locked so as to be movable in the back and forth direction in accordance with the rotation of the knock body 106. For example, it is possible to employ a screw structure in which the external screw part 122*b* is provided on the outer surface of the knock body 106 and the internal screw part 123*a* is provided on the inner surface of the slidable member 123 so as to be screw-fitted. Alternatively, it is possible to employ a cam structure in which a projection is provided on the outer surface of the knock body 106, and a cam slant which is in contact with the projection of the slidable member 123 and is inclined with respect to the axial direction, so that the projection is moved along the cam slant when the knock body 106 is rotated.

The knock body 106 and the slide member 105 are locked so as to be rotatable and immovable in the back and forth direction, and the slidable member 123 and the slide member 105 are locked so as to be unrotatable and movable in the back and forth direction. Thus, in the case of the screw structure, when the knock body 106 is rotated, the slidable member 123 is not rotated while the slidable member 123 is configured to be moved in the back and forth direction correspondingly to the displaced locking position of the screw. In the case of the cam structure, the slidable member 123 is configured to be moved in the back and forth direction correspondingly to the contact position between the inclined cam slant and the projection, which is displaced in the back and forth direction in accordance with the rotation of the knock body 106.

It is preferable that, in the not-knocked state in which the ballpoint refill 108 is in the shaft tube 104, the spring force of the first spring body (first coil spring) 114 is configured to be lower than the spring force of the second spring body (second coil spring) 115. In this case, since the cylinder 117 is pushed to the front side by the second spring body 115 during the not-knocked state, no pressure is applied to the writing implement ink composition 111. Thus, leakage of ink during the not-writing state can be prevented.

Further, when the knocking operation is performed so that the knock body 106 is pushed to the front side so that the ballpoint refill 108 is projected from the front end opening 103*a* of the shaft tube 104, the spring force of the first spring body (first coil spring) 114 is configured to be lower than the spring force of the second spring body (second coil spring) 115. Thus, since the cylinder 117 and the refill 108 pushed to the front side by the second spring body 115 move to the front side against the first spring body 114, there is no possibility that the pressurized chamber (pressurized space) 120 in the cylinder 117 is pressurized also in the knocked state. Thus, the pressurized-type writing implement can be used as a writing pressure type, in which when starting writing to apply a writing pressure to the distal end of the ballpoint refill 108, the ballpoint refill 108 pressed by the writing pressure is moved to the back side against the spring force of the second spring body 15 so that the cylinder 117 is simultaneously moved to the back side, whereby the pressurized chamber 120 in the cylinder 117 is pressurized so that a pressure is applied to the back end of the writing implement ink composition 111.

When the spring force of the first spring body (first coil spring) 114 is configured to be higher than the spring force of the second spring body (second coil spring) 115 during the knocked state, since the ballpoint refill 108 pushed to the back side by the first spring body 114 pushes the cylinder 117, the inside of the cylinder 117 is pressurized. Thus, since the writing implement ink composition 111 is quickly pressurized by the knocking operation, the pressurized-type writing implement 101 can be used as a knock pressure-type writing implement capable of writing with a pressurizing force being increased from the start of writing.

Further, a display unit may be provided on an outer surface of the knock body 106. When a step part and the projection of the knock body 106 come into contact with each other, a state in which the display unit of the knock body 16 and a display unit provided on the outer surface of the tube shaft 4 may express a pressurizing force level.

The pressurizing force level may be expressed by using numeric characters (0, 1, 2, 3 . . . ), characters (H, M, L, N) or symbols, which are not specifically limited.

The pressurized-type writing implement 1, 101 of the present invention can be embodied regardless of a type of the ink, such as an oil-based ink or a water-based ink. In particular, when a water-based ink or a water-based shear-rate thinning ink is used, since an amount of ink ejected by pressurization largely varies so that a handwriting thickness/width and a handwriting density largely vary when a pressurizing force changes, the writing implement can be suitably used. Further, in a writing implement using a thermochromic microcapsule pigment, an amount of ink to be ejected is particularly large in a general state (unpressurized state), and an impact on a total writing distance is large. Thus, the effect of the present invention in which a pressurizing force can be varied according to use is significant.

Next, another modification example is described with reference to the FIGS. 19 to 24. In the below description and the drawings used in therein, the same reference number is used to a part that can be similarly structured as the first embodiment, and overlapped description is omitted. When it is apparent that the same effect obtained in the first embodiment is obtained in the modification example, the description is sometimes omitted.

In a pressurized writing implement 201 in this modification example, an example in which a thermochromic ink is used as the writing implement ink composition filled in the ballpoint refill 108 is described. The writing implement ink composition 11 in this modification example is a reversible thermochromic ink containing a reversible thermochromic microcapsule pigment. Thus, a handwriting to be formed is thermochromic, and thus fades or loses color by heating or cooling. Note that the writing implement ink composition 11 is not limited to the thermochromic ink, and another ink composition may be used.

An average particle diameter of the microcapsule pigment is preferably between 0.1 μm and 5.0 μm, more preferably between 0.1 μm and 4.0 μm, and further preferably between 0.5 μm and 3.0 μm. When the average particle diameter of the microcapsule pigment is included in the above numerical range, a writing feeling of the writing implement can be more smoothened, while good color development of a high density is maintained. A particle diameter and a particle size distribution can be measured by a Coulter method (electric detection band method), for example. To be specific, a particle diameter is measured by using a precision distribution measuring device (Multisizer 4*e* manufactured by Beckman Coulter Co., JP), and an average particle diameter (median diameter) is calculated based on the numerical values on a volume basis. Alternatively, a particle diameter is measured by using a laser diffraction/scattering particle size distribution measuring device (LA-300 manufactured by HORIBA, Ltd.), an average particle diameter (median diameter) can be calculated based on a numerical value calibrated by a standard sample on a volume basis.

A contained amount of the reversible thermochromic microcapsule pigment with respect to the total amount of the ink composition is preferably between 5 and 40% by mass, more preferably between 10 and 40% by mass, and further preferably between 15 and 35% by mass. When the contained amount of the reversible thermochromic microcapsule pigment is included in the numerical range, a color development can be improved, while ink outflow property is maintained.

A color change temperature of the reversible thermochromic ink in the present invention can be suitably set according to its purpose. For example, when a reversible thermochromic ink that loses color by heating is used, a temperature at which the ink loses color by heating is preferably set between 25° C. and 95° C., more preferably between 36° C. and 90° C. To be more specific, a high-temperature side color change point [perfect color lost temperature (t4)] can be set in a range between 25° C. and 95° C., preferably in a range between 36° C. and 90° C., and a low-temperature side color change point [perfect color development temperature (t1)] can be set in a range between −30° C. and +20° C., preferably in a range between −30° C. and +10° C. Due to this structure, a hue can be effectively held in a general state (daily life temperature range), and a color of a handwriting can be easily lost by heating, specifically, by a frictional heat caused by a friction body 220 described later.

Figure 19:
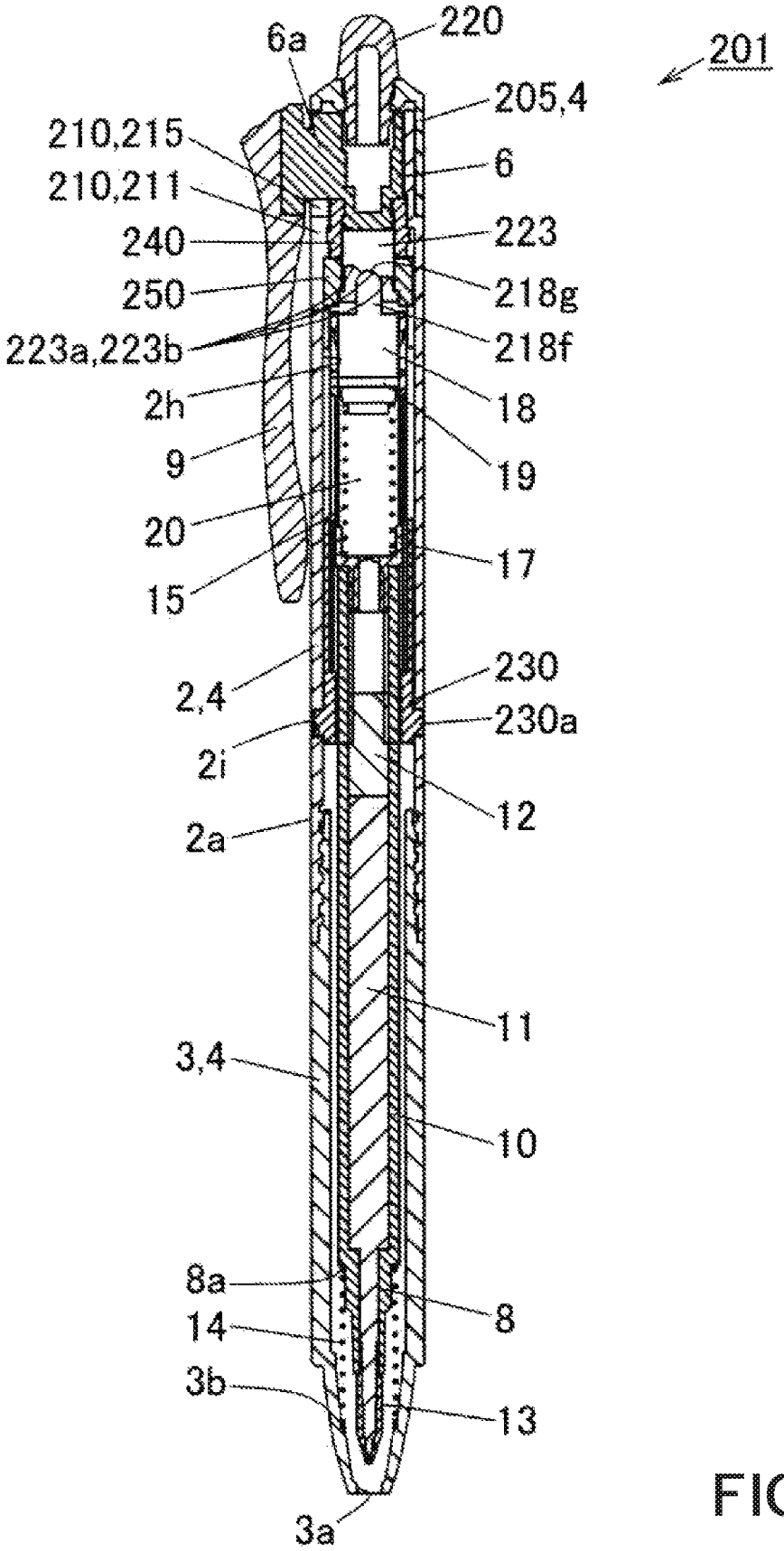
FIG. 19 is a view showing another modification example of the pressurized-type writing implement, which is a longitudinal sectional view of the pressurized-type writing implement in the not-knocked state.
Figure 20:
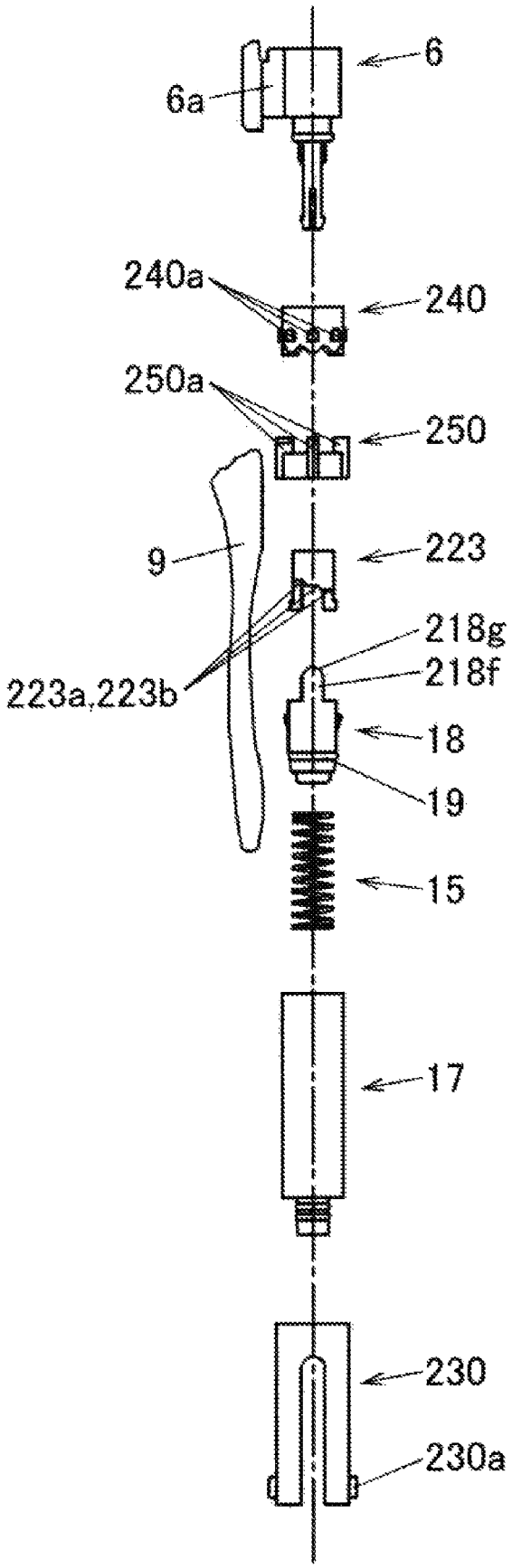
FIG. 20 is an exploded view for describing a structure of internal components of the pressurized-type writing implement of FIG. 19.
Figure 21:
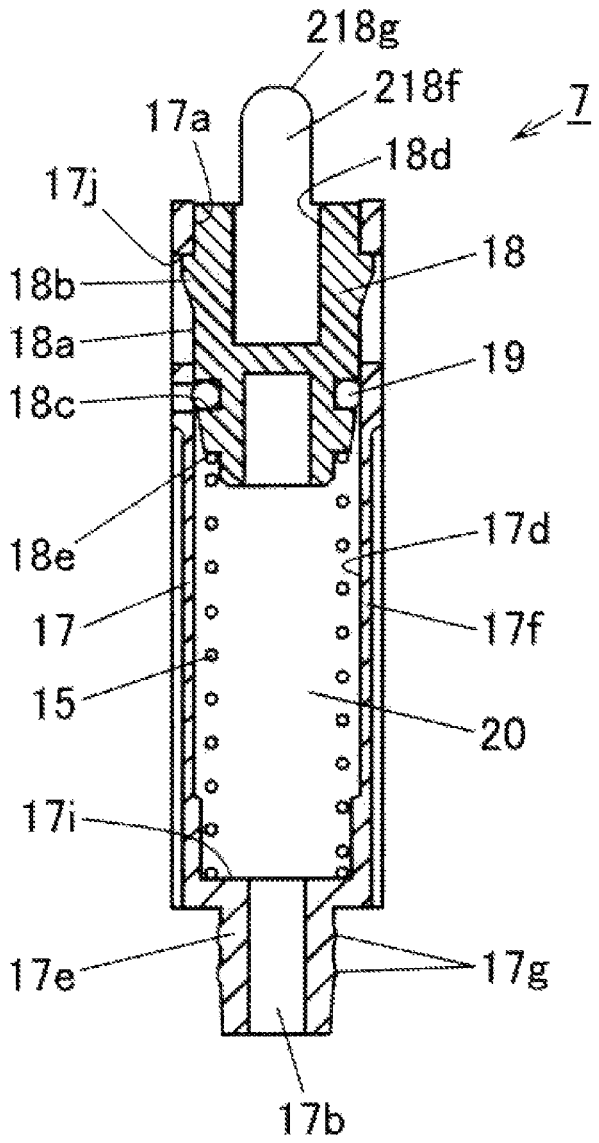
FIG. 21 is a longitudinal sectional view showing a pressurizing mechanism of the pressurized-type writing implement of FIG. 19.

FIG. 19 is a pressurized-type writing implement 201 in this modification example, which is a longitudinal sectional view of the pressurized-type writing implement in the not-knocked state. FIG. 20 is an exploded view for describing a structure of internal components of the pressurized-type writing implement 201 of FIG. 19. FIG. 21 is a longitudinal sectional view showing a pressurizing mechanism 7 of the pressurized-type writing implement 201 of FIG. 19.

In the illustrated example, a shaft tube 4 has a back shaft 2, a front shaft 3 and a back tube 205. The back tube 205 is disposed on the back side of the back shaft 2 and is locked so as to be rotatable and immovable in the back and forth direction with respect to the back shaft 2. A friction body 220 is irremovably locked on a back end of the back tube 205. The friction body 220 is used for frictioning a handwriting by the writing implement ink composition 11 having a thermochromic property for example so as to fade (lose) color of the handwriting by a generated frictional heat. Not limited thereto, the friction body 220 may be a friction body such as a sand eraser or the like. The friction body 220 is made of, e.g., an elastic material, and can be fixed on the back end of the back tube 205 by press-fitting, engagement, screwing, fitting, attachment or bicolor molding.

A knock body 6 has a slide part 6*a* extending outwardly from a body of the knock body 6. A clip 9 is fixed on the slide part 6*a* outside the shaft tube 4.

The shaft tube 4 has a slit part 210 for pushing the knock body 6 to the front side so as to slide the slide part 6*a* in the back and forth direction. The slit part 210 includes a front slit 211 provided on a back part of the back shaft 2, and a back slit 215 provided on a front part of the back tube 205. In the illustrate example, the front slit 211 has three slits, i.e., a first slit 212, a second slit 213 and a third slit 214. However, not limited thereto, the front slit 211 may include two slits or may include four or more slits. The front slit 211 (slits 212 to 214) passes through the back shaft 2 from the inside to the outside. In addition, the front slit 211 linearly extends along the back and forth direction, and opens to the back end of the back shaft 2. A back slit 215 includes one slit. The back slit 215 passes through the back tube 205 from the inside to the outside. The back slit 215 linearly extends along the back and forth direction, and opens to the front end of the back tube 205.

When a user rotates the back tube 205 with respect to the back shaft 2, the back slit 215 is aligned in the back and forth direction with the first slit 212 of the front slit 211, the second slit 213 thereof or the third slit 214 thereof. Thus, the back slit 215 is in communication with any of the first slit 212, the second slit 213 and the third slit 214 in the back and forth direction. At this time, the slide part 6*a* of the knock body 6 can be moved along the back and forth direction, between the inside of the back slit 215 and the inside of one of the slits 212 to 214 in communication with the back slit 215.

A tubular body 230 is disposed inside the shaft tube 4. The tubular body 230 has a substantially tubular shape as a whole. A projection 230*a* of the tubular body 230 is locked in a recess 2*i* formed in an inner surface of the shaft tube 4, so that the tubular body 230 is fixed so as to be unrotatable and immovable in the back and forth direction with respect to the shaft tube 4. In the illustrated example, the recess 2*i* is formed as a through-hole passing through the shaft tube 4 from the inside to the outside.

A cylinder 17 is locked so as to be unrotatable and movable in the back and forth direction with respect to the tubular body 230. A piston 18 is locked so as to be unrotatable and movable in the back and forth direction with respect to the cylinder 17. The piston 18 in this modification example has on this back part a protrusion 218*f* projecting to the back side. An arcuate locking part 218*g* is formed on a back end of the protrusion 218*f*.

A cam member 223 is disposed on the back side of the piston 18. The cam member 223 is locked so as to be unrotatable and movable in the back and forth direction with respect to the knock body 6. The cam member 223 has on its front part a cam slant 223*a* extending in an inclined manner form a front end surface to the back side. The cam slant 223*a* has a stepped shape having a plurality of steps 223*b*. The protrusion 218*f* elastically urged by the second coil spring 15 to the back side is selectively engaged with any of the steps 223*b*.

An operation body 240 and an intermediate member 250 are disposed outside the cam member 223 so as to surround the cam member 223. The operation body 240 is disposed on the back side with respect tot the intermediate member 250. A guide projection 240*a* is formed on a side surface of the operation body 240. On the other hand, a plurality of engagement grooves 2*h* in an inner surface of the shaft tube 4. The guide projection 240*a* of the operation body 240 is inserted in the engagement groove 2*h* of the shaft tube 4, and the operation body 240 is locked so as to be unrotatable and movable in the back and forth direction with respect to the shaft tube 4. In addition, the operation body 240 is locked so as to be rotatable and immovable in the back and forth direction with resect to the knock body 6.

The intermediate member 250 has on its side surface a cam projection 250*a* that projects outward and extends to the back side. The intermediate member 250 is configured to be rotatable with respect to the shaft tube 4. When the pressurized-type writing implement 201 is of a knock pressure type, a front end of the intermediate member 250 is in contact with a back end of the cylinder 17 after knocked, so as to be elastically urged to the back side by a first coil spring 14 pressing the ballpoint refill 8 to the back side and a second coil spring 15 in the cylinder 17.

The operation body 240, the intermediate member 250 and the plurality of engagement groove 2*h* of the shaft tube 4 constitute a projecting and retracting mechanism of the ballpoint refill 8. Since the operation body 240, the intermediate member 250 and the engagement grooves 2*h*, which constitute the projecting and retracting mechanism, can be manufactured similarly to a projecting and retracting mechanism described in JP2013-006281A with reference to FIGS. 11 and 12, for example, detailed description of shapes and operations of the respective members is omitted.

Figure 22A:
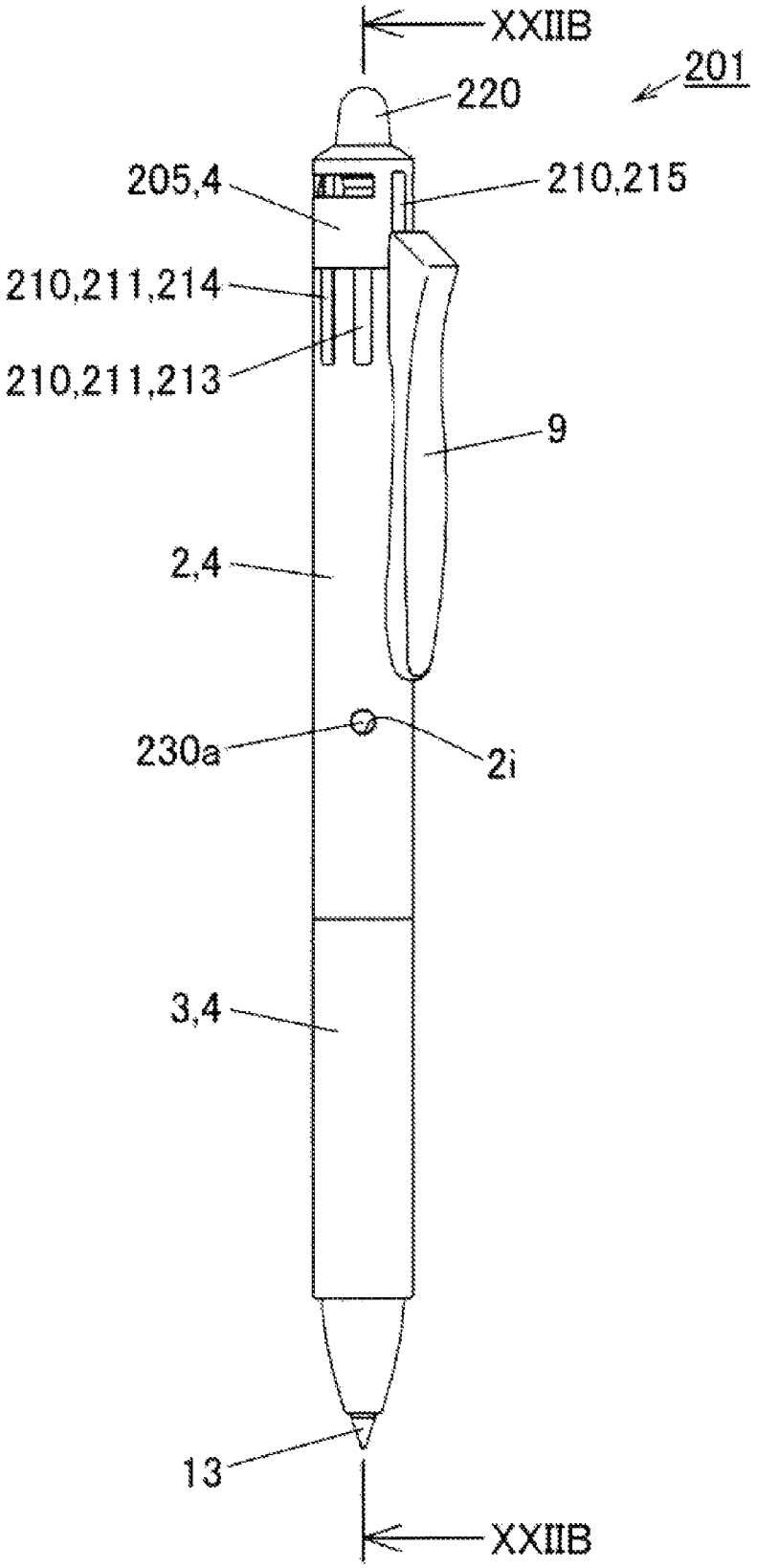
FIG. 22A is view showing an appearance of the pressurized-type writing implement of FIG. 19 in the knocked state, with no pressurizing force being set to be applied.
Figure 22B:
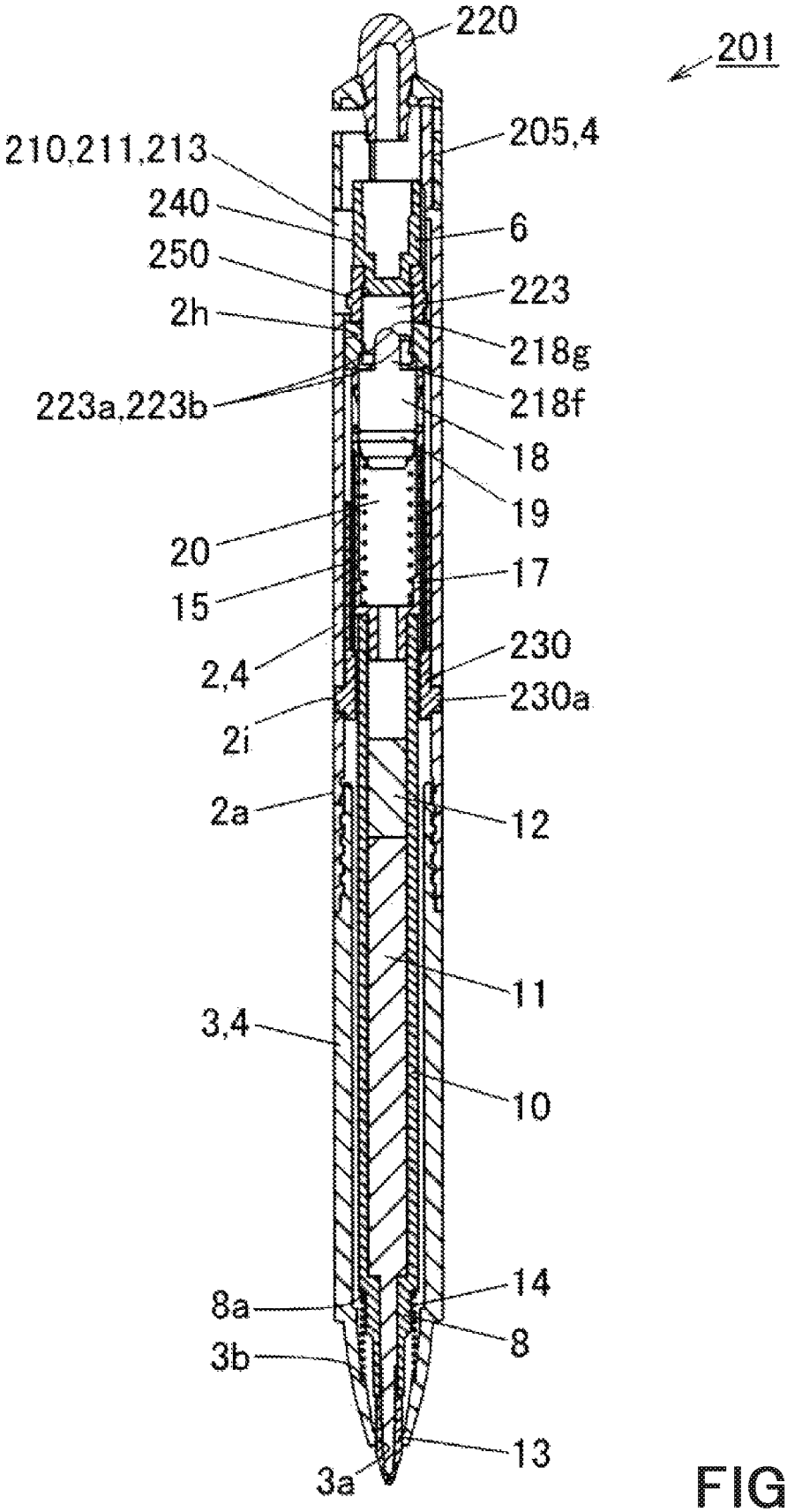
FIG. 22B is a longitudinal sectional view of the pressurized-type writing implement of FIG. 22A.
Figure 23A:
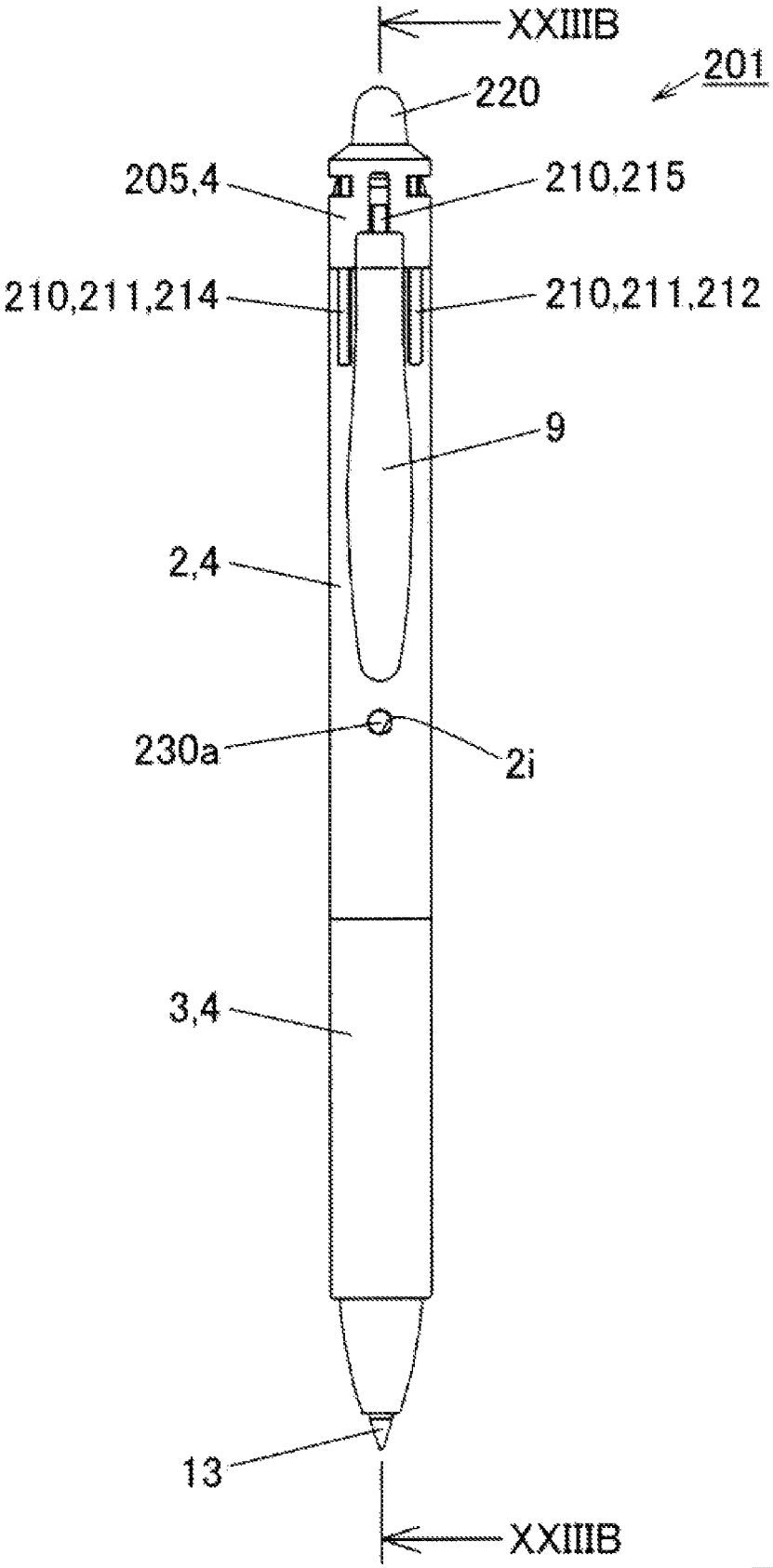
FIG. 23A is a view showing an appearance of the pressurized-type writing implement of FIG. 19 in the knocked state, with a pressurizing force being set at a relatively low pressure.
Figure 23B:
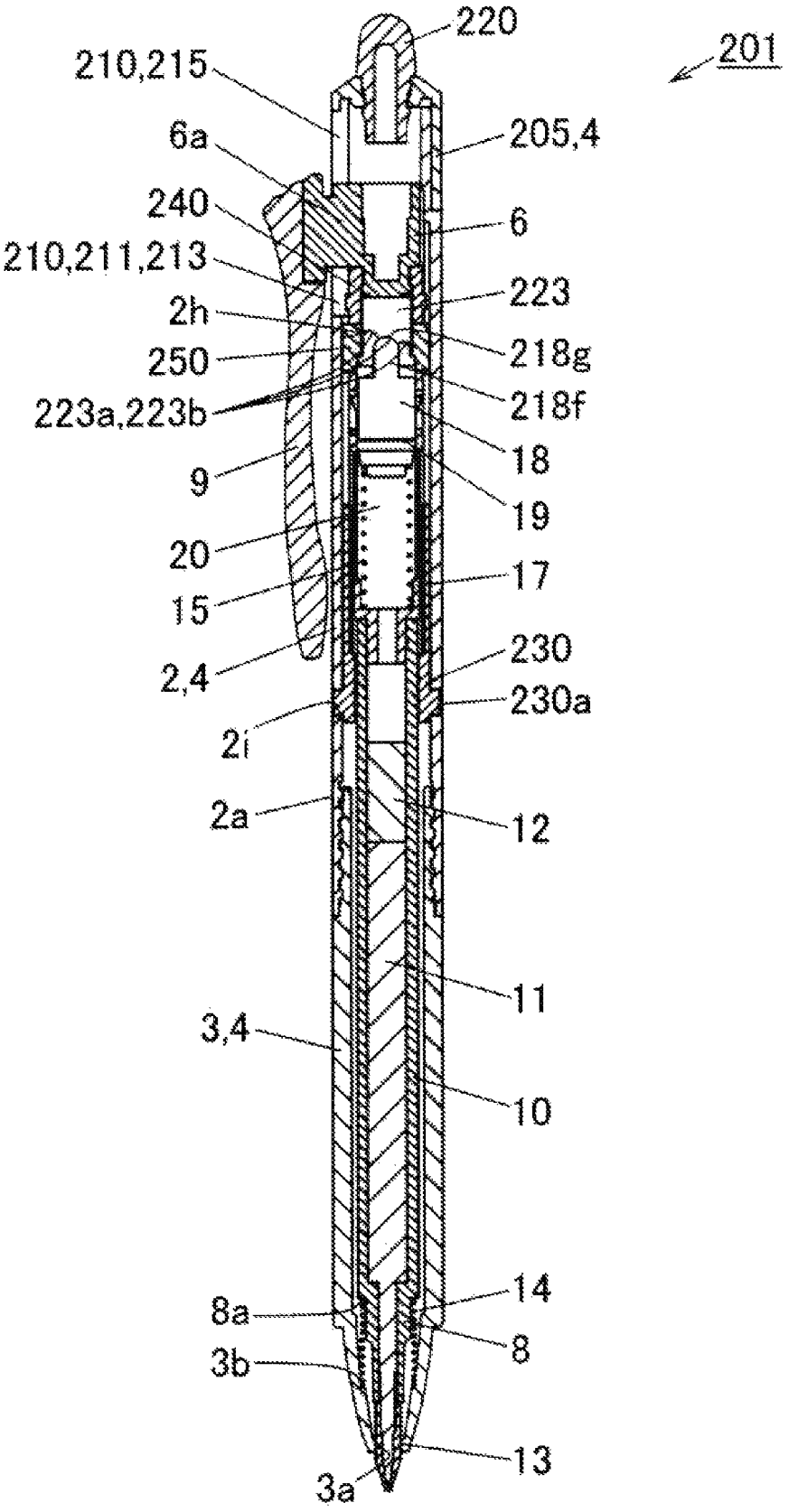
FIG. 23B is a longitudinal sectional view of FIG. 23A.
Figure 24A:
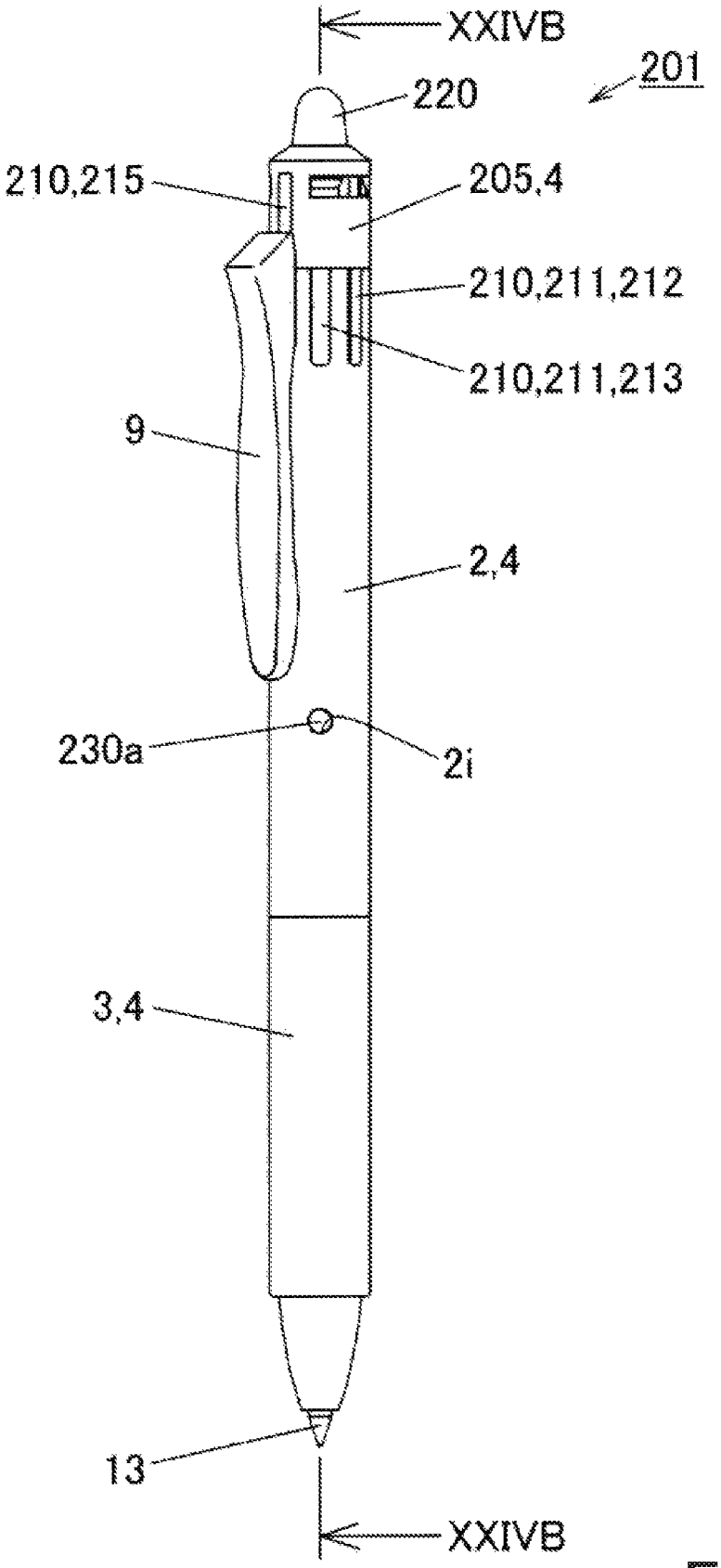
FIG. 24A is a view showing an appearance of the pressurized-type writing implement of FIG. 19 in the knocked state, with a pressurizing force being set at a relatively high pressure.
Figure 24B:
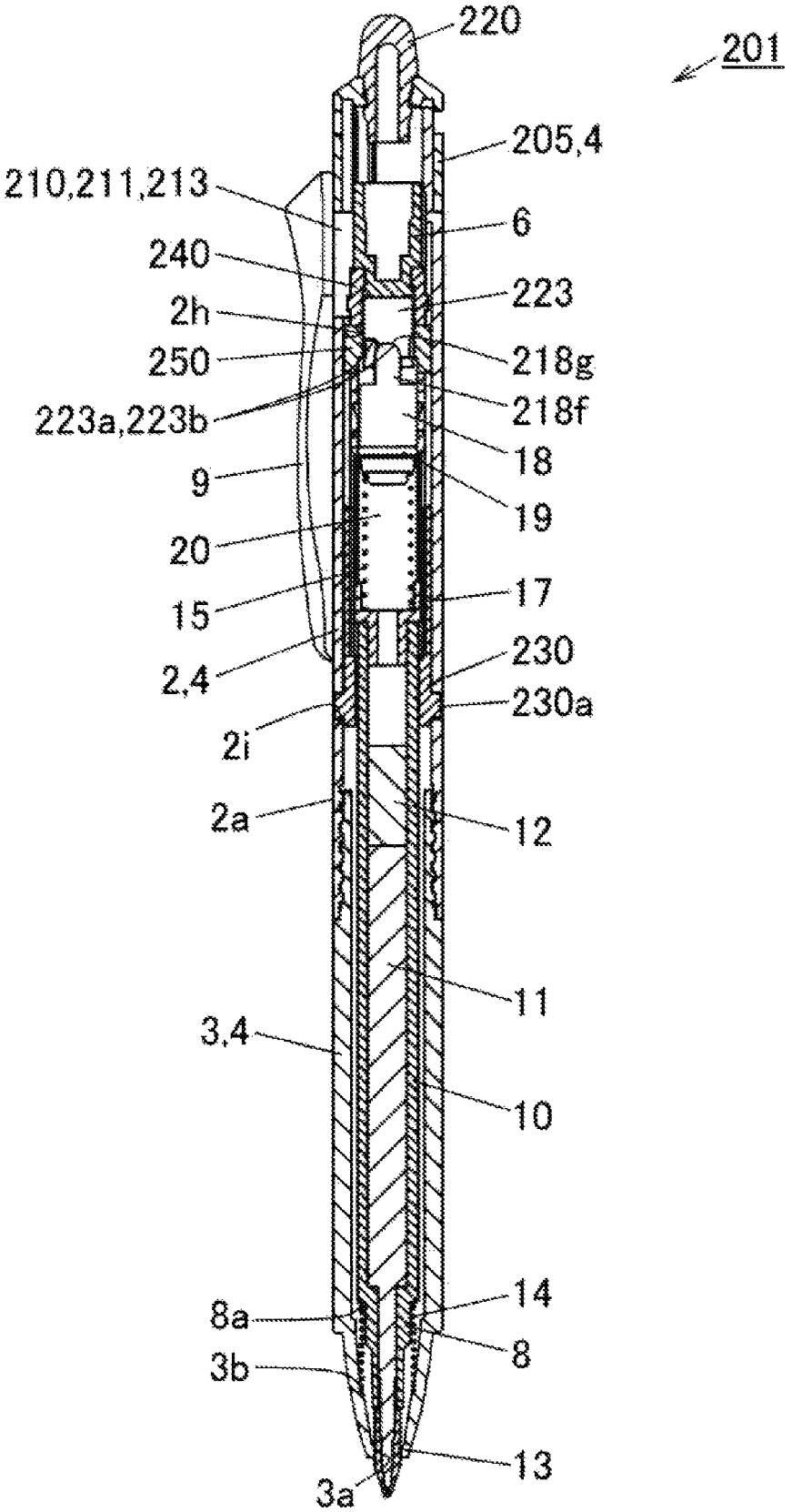
FIG. 24B is a longitudinal sectional view of FIG. 24A.

Next, an operation for rotating the knock body 6 so as to change a pressurizing force setting is described with reference to FIGS. 22A to 24B. FIG. 22A is view showing an appearance of the pressurized-type writing implement in this modification example in the knocked state, with no pressurizing force being set to be applied. FIG. 22B is a longitudinal sectional view along the XXIIB-XXIIB line in FIG. 22A. FIG. 23A is a view showing an appearance of the pressurized-type writing implement 201 in this modification example in the knocked state, with a pressurizing force being set at a relatively low pressure. FIG. 23B is a longitudinal sectional view along the XXIIIB-XXIIIB line FIG. 23A. FIG. 24A is a view showing an appearance of the pressurized-type writing implement 201 in this modification example in the knocked state, with a pressurizing force being set at a relatively high pressure. FIG. 24B is a longitudinal sectional view along the XXIVB-XXIVB line FIG. 24A.

In the not-knocked state, the slide part 6*a* of the knock body 6 is inserted in the back slit 215 of the back tube 205. In this not-knocked state, by rotating the knock body 6 (clip 9) together with the back tube 205 with respect to the shaft tube 4, a setting for compressing the pressurized chamber 20 can be changed. When the knock body 6 and the back tube 205 are rotated with respect to the shaft tube 4, since the cam member 223 is locked so as to be unrotatable with respect to the knock body 6, the cam member 223 is rotated with respect to the knock body 6. At this time, the protrusion 218*f* of the piston 18 is moved to an adjacent step along the cam slant 223*a* of the cam member 223. Since the piston 18 is moved in the back and forth direction correspondingly to the positional difference between these steps in the back and forth direction, a pressurization amount in the pressurized chamber 20 upon knocked changes. When the knock body 6 is rotated, the back slit 215 of the back tube 205 is rotated from a state in which a position of the back slit 215 in the back and forth direction corresponds to one of the three slits 212 to 214 of the shaft tube 4, to a state in which its position in the back and forth direction corresponds to an adjacent slit 212 to 214. In this modification example, when the back slit 215 and the first slit 212 are aligned with each other in the back and forth direction, no pressurizing force caused by a pressurizing-force adjusting mechanism is set to be applied to the writing implement ink composition 11. In addition, when the back slit 215 and the second slit 213 are aligned with each other in the back and forth direction, a relatively low pressurizing force caused by the pressurizing-fore adjusting mechanism is set to be applied to the writing implement ink composition 11. Further, when the back slit 215 and the third slit 214 are aligned with each other in the back and forth direction, a relatively high pressurizing force caused by the pressurizing-fore adjusting mechanism is set to be applied to the writing implement ink composition 11.

When the knock body 6 (clip 9) is pushed so as to be slid to the front side in the not-knocked state, the slide part 6*a* of the knock body 6 moves from the back slit 215 to the front slit 211 (slit 212 to 214). At this time, since the protrusion 218*f* (locking part 218*g*) is in contact with the cam slant 223*a* of the cam member 223, the piston 18 is pressed by the cam member 223 so as to move to the front side, and the cylinder 17 is pressed by the piston 18 so as to also move to the front side.

When the pressurized writing implement 201 is of knock pressure type, a relationship between a spring force of the second coil spring 15 in the pressurized chamber 20 and a spring force of the first coil spring 14 that elastically urges the ballpoint refill 8 to the back side upon attachment is such that the spring force of the first coil spring 14 is smaller than the spring force of the second coil spring 15. The relationship between the first coil spring 14 and the second coil spring 15 after the knocking operation is such that the spring force of the first coil spring 14 is larger than the spring force of the second coil spring 15. Thus, when the spring force of the first coil spring 14 exceeds the second coil spring 15 during the knocking operation, the piston 18 is relatively moved to the front side with respect to the cylinder 174 (forward movement of the cylinder 17 is temporarily stopped). Then, at a time point when the back end of the cylinder 17 and the front end of the intermediate member 250 come into contact with each other, the cylinder 17 is pressed by the intermediate member 250 so as to start the forward movement again. At this time, the piston 18 is moved to the front side with respect to the cylinder 17 so that communication between an air hole formed in a side surface of the cylinder 17 and the inside of the pressurized chamber 20 is blocked by an O-ring 19 fixed on a side surface of the piston 18. Thus, the inside of the pressurized chamber 20 becomes air tight. When the piston 18 is further moved to the front side with respect to the cylinder 17, the inside of the pressurized chamber 20 is compressed and pressurized.

When the pressurized-type writing implement 201 is of a writing pressure type, a relationship between a spring force of the second coil spring 15 in the pressurized chamber 20 and a spring force of the first coil spring 14 that elastically urges the ballpoint refill 8 to the back side upon attachment is such that the spring force of the first coil spring 14 is smaller than the spring force of the second coil spring 15. The relationship between the first coil spring 14 and the second coil spring 15 after the knocking operation is such that the spring force of the first coil spring 14 is smaller than the spring force of the second coil spring 15. Thus, the protrusion 218*f* of the piston 18 is pressed by the cam slant 223*a* of the cam member 223 so as to move to the front side, while a most forward position of the cylinder 17 with respect to the piston 18 by the spring force of the second coil spring 15. At this time, the intermediate member 250 is also pressed by a contact surface 240*b* of the operation body 240 so as to move to the front side.

In the pressurized-type writing implement 201 in this modification example, the writing implement ink composition 11 is a thermochromic ink. The pressurized-type writing implement 201 has the friction body 220 provided on the back end of the shaft tube 4, which is capable of frictioning a handwriting of the thermochromic ink so as to fade color of the handwriting by a generated frictional heat.

According to the pressurized-type writing implement 201, the pressurized-type writing implement 201 is capable of switching the writing state and the not-writing state, with using a thermochromic ink as the writing implement ink composition, and a pressure acting on the writing implement ink composition filled in the refill can be adjusted in accordance with a user's taste.

What is claimed is:

1. A pressurized writing implement comprising:

a shaft tube capable of housing therein a refill filled with a writing implement ink composition; and a pressurizing mechanism that applies a pressure to the writing implement ink composition;

the pressurized writing implement being capable of switching a writing state in which a front end part of the refill projects from a front end opening of the shaft tube, and a not-writing state in which the front end part of the refill is retracted from the front end opening of the shaft tube, wherein the pressurized writing implement has a pressurizing-force adjusting mechanism that adjusts the pressure.

2. The pressurized writing implement according to claim 1, wherein:

the writing implement ink composition is a thermochromic ink; and a friction body is provided on a back end of the shaft tube, the friction body being capable of frictioning a handwriting of the thermochromic ink so as to discolor the handwriting by a frictional heat generated upon frictioning.

3. A pressurized writing implement comprising:

a shaft tube configured to house therein a ballpoint refill, wherein the ballpoint refill includes an ink storage tube filled with a writing implement ink composition, and a ballpoint tip on a front part of the ink storage tube; and a pressurized chamber and a pressurizing mechanism that applies a pressure to the pressurized chamber, the pressurized chamber and the pressurizing mechanism being disposed on a back side of the ballpoint refill, wherein the pressurized chamber is in communication with a back end of the writing implement ink composition;

wherein:

a front end of the ballpoint refill is configured to project from a front end opening of the shaft tube by pushing a knock body disposed on a back side of the pressurizing mechanism toward a front side of the pressurized writing implement;

a pressurizing-force adjusting mechanism is disposed on the back side of the pressurizing mechanism, wherein the pressurizing-force adjusting mechanism increases or decreases a volume of the pressurized chamber at least during writing, by rotating the knock body;

a first spring body is disposed between an outer step part of the ballpoint refill and an inner step part of the shaft tube, so as to elastically urge the ballpoint refill toward a back end of the shaft tube; and when the knock body is pushed toward the front side of the pressurized writing implement or when the ballpoint refill is moved toward the back end of the shaft tube by a writing pressure upon writing, the pressurizing mechanism is actuated so as to apply a pressure to the back end of the writing implement ink composition.

4. The pressurized writing implement according to claim 3, wherein:

a slide member that is formed to be movable in a back and forth direction with respect to the shaft tube is disposed outside the knock body, the knock body is locked so as to be rotatable and immovable in the back and forth direction with respect to the slide member, and a cam member that is disposed on a front side of the knock body is locked so as to be movable in the back and forth direction and unrotatable with respect to the slide member; and the slide member, the knock body and the cam member constitute the pressurizing-force adjusting mechanism.

5. The pressurized writing implement according to claim 3, wherein:

the writing implement ink composition is a thermochromic ink; and a friction body is provided on a back end of the shaft tube, the friction body being capable of frictioning a handwriting of the thermochromic ink so as to discolor the handwriting by a frictional heat generated upon frictioning.

6. The pressurized writing implement according to claim 3, wherein:

the pressurizing mechanism comprises a cylinder connected to a back end part of the ink storage tube and having an air hole communicating an inside and an outside with each other, a piston disposed in a back end opening of the cylinder so as to be movable in a back and forth direction with respect to the cylinder, a sealing member that closes the air hole of the cylinder, a second spring body disposed between the cylinder and the piston so as to elastically urge the cylinder toward the front side of the pressurized writing implement, and the pressurized chamber formed between an inner wall of the cylinder and a front end of the piston so as to be in communication with a back end opening of the ink storage tube; and in a not-knocked state in which the ballpoint refill is in the shaft tube, a spring force of the first spring body is configured to be smaller than a spring force of the second spring body.

7. The pressurized writing implement according to claim 6, wherein in a knocked state in which the knock body is pushed toward the front side of the pressurized writing implement so that the ballpoint refill is projected from the front end opening of the shaft tube, the spring force of the first spring body is configured to be larger than the spring force of the second spring body.

8. The pressurized writing implement according to claim 6, wherein in a knocked state in which the knock body is pushed toward the front side of the pressurized writing implement so that the ballpoint refill is projected from the front end opening of the shaft tube, the spring force of the first spring body is configured to be smaller than the spring force of the second spring body.

9. A pressurized writing implement comprising:

a shaft tube configured to house therein a ballpoint refill, wherein the ballpoint refill includes an ink storage tube filled with a writing implement ink composition, and a ballpoint tip on a front part of the ink storage tube;

a pressurizing mechanism that applies a pressure to a back end of the writing implement ink composition, the pressurizing mechanism being disposed on a back side of the ballpoint refill; and a projecting and retracting mechanism, which is pushed to a front side to project a front end part of the ballpoint refill from a front end opening of the shaft tube, disposed on a back side of the pressurizing mechanism;

wherein:

the projecting and retracting mechanism comprises: a slide member disposed so as to be movable in a back and forth direction and unrotatable with respect to the shaft tube; a knock body rotatably locked on a back part of the slide member, and projecting from a back end of the shaft tube; and a slidable member disposed inside the slide member and locked so as to be movable in the back and forth direction and unrotatable with respect to the slide member;

the slidable member is locked on the knock body so as to be moved in the back and forth direction in accordance with the rotation of the knock body, with a front end thereof being in contact with a back end of the pressurizing mechanism;

a first spring body is disposed between an outer step part of the ballpoint refill and an inner step part of the shaft tube so that the ballpoint refill is elastically urged toward the back end of the shaft tube;

by pushing the knock body of the projecting and retracting mechanism toward a front side of the pressurized writing implement, an engagement part formed on an outer wall of the slide member is engaged with an engaged part on a front part of a clip provided on a back part of the shaft tube so that the front end part of the ballpoint refill is maintained to project from the front end opening of the shaft tube, and by pushing a back end part of the clip so as to disengage the engagement state between the engagement part and the engaged part of the clip, the slide member is moved toward a back side of the pressurized writing implement by a spring force of the first spring body so that the front end part of the ballpoint refill is retracted into the front end opening of the shaft tube; and while the front end part of the ballpoint refill is maintained to project from the front end opening of the shaft tube, the pressurizing mechanism is actuated by the ballpoint refill which is moved toward the back side of the pressurized writing implement by a writing pressure upon writing so as to apply a pressure to the back end of the writing implement ink composition.

10. The pressurized writing implement according to claim 9, wherein:

the writing implement ink composition is a thermochromic ink; and a friction body is provided on the back end of the shaft tube, the friction body being capable of frictioning a handwriting of the thermochromic ink so as to discolor the handwriting by a frictional heat generated upon frictioning.

11. The pressurized writing implement according to claim 9, wherein:

the pressurizing mechanism comprises a cylinder connected to a back end part of the ink storage tube and having an air hole communicating an inside and an outside with each other, a piston disposed in a back end opening of the cylinder so as to be movable in the back and forth direction with respect to the cylinder, a sealing member that closes the air hole of the cylinder, a second spring body disposed between the cylinder and the piston so as to elastically urge the cylinder to the front side, and the pressurized chamber formed between an inner wall of the cylinder and a front end of the piston so as to be in communication with a back end opening of the ink storage tube; and in a not-knocked state in which the ballpoint refill is in the shaft tube, a spring force of the first spring body is configured to be smaller than a spring force of the second spring body.

12. The pressurized writing implement according to claim 11, wherein in a knocked state in which the knock body is pushed toward the front side of the pressurized writing implement so that the ballpoint refill is projected from the front end opening of the shaft tube, the spring force of the first spring body is configured to be larger than the spring force of the second spring body.

13. The pressurized writing implement according to claim 11, wherein in a knocked state in which the knock body is pushed toward the front side of the pressurized writing implement so that the ballpoint refill is projected from the front end opening of the shaft tube, the spring force of the first spring body is configured to be smaller than the spring force of the second spring body.

* * * * *